US006167812B1

(12) United States Patent
Pugin et al.

(10) Patent No.: US 6,167,812 B1
(45) **Date of Patent: *Jan. 2, 2001**

(54) ELEVATED CABLEWAY SYSTEM

(75) Inventors: Andre O. Pugin, Corseaux (CH); Ben Lamoreaux, Cedar City, UT (US); Per Aasheim, Vevey (CH)

(73) Assignee: Aerobus International Inc., Houston, TX (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/028,621

(22) Filed: Feb. 24, 1998

Related U.S. Application Data

(63) Continuation-in-part of application No. 08/510,479, filed on Aug. 2, 1995, now Pat. No. 5,720,225.

(51) Int. Cl.[7] ..... E01B 25/00

(52) U.S. Cl. ..... 104/123

(58) Field of Search ..... 104/123, 124, 104/125, 126, 112; 14/8, 11, 18, 19, 20, 21, 22, 23, 26

(56) References Cited

U.S. PATENT DOCUMENTS

| | | | | |
|---|---|---|---|---|
| 804,744 | * | 11/1905 | Lindenthal | 14/21 |
| 3,091,190 | | 5/1963 | Cruciani | 104/115 |
| 3,092,326 | | 6/1963 | Hohla | 238/119 |

(List continued on next page.)

FOREIGN PATENT DOCUMENTS

| | | | |
|---|---|---|---|
| 588372 | 5/1977 | (CH) . | |
| 592206 | 10/1977 | (CH) . | |
| 0207887 | 7/1987 | (EP) | E01B 25/18 |

OTHER PUBLICATIONS

Suspended Light Rail System Technology Pilot Project, vol. 1 Proposal, Milwaukee County, Aerobus of Texas, Inc., 150 pages, (Sep. 29, 1993).

Suspended Light Rail System Technology Pilot Project, vol. 2: References, Milwaukee County, Aerobus of Texas, Inc., 238 pages, (Sep. 29, 1993).

Assessment Of The Mueller Aerobus System, The System Installed and Operated for the Bundesgartenschau 1975, Mannheim, Germany, U. S. Department of Transportation Urban Mass Transportation Administration, Washington D. C., Final Report, 258 pages, (Sep. 1979).

(List continued on next page.)

* cited by examiner

*Primary Examiner*—Mark T. Le
(74) *Attorney, Agent, or Firm*—Frank S. Vaden, III; Felsman, Bradley, Vaden, Gunter & Dillon, L.L.P.

(57) ABSTRACT

An improved cableway system for providing a track over which a vehicle traverses. The improved system includes a catenary cable system and a pair of track cable systems. The track cable systems are hung from the catenary cable system and support tracks over which a vehicle traverses. A plurality of hangers is employed to suspend the track cable systems from the catenary cable system. A plurality of pylons support the catenary and track cable systems. A pylon includes a base pylon, a lower saddle, and an upper saddle. The lower saddle is pivotally mounted to the base pylon and supports the track cable systems. Preferred embodiments of the lower saddle include apparatuses that dampen the application of loads to the pylon by the vehicle traversing the system. The upper saddle is supported by the base pylon and supports the catenary cable system while providing for deflection of the catenary cable system in response to forces applied to the cableway system. A preferred embodiment of the cableway system includes a force equalizing assembly for joining the catenary cable system to the track cable system at points between support pylons to equalize the tension in the cables among the various cables.

7 Claims, 23 Drawing Sheets

U.S. PATENT DOCUMENTS

| | | | |
|---|---|---|---|
| 3,464,365 | 9/1969 | Bertin | 104/125 |
| 3,550,536 | 12/1970 | Lesh | 104/124 |
| 3,590,743 | 7/1971 | Larson | 104/130 |
| 3,604,361 | 9/1971 | Harbert | 104/123 |
| 3,690,266 | 9/1972 | Mayo | 104/123 |
| 3,753,406 | 8/1973 | Müller | 104/112 |
| 3,903,807 | 9/1975 | Lee | 104/131 |
| 3,985,081 | 10/1976 | Sullivan, II | 104/23 |
| 4,002,125 | 1/1977 | Spoler | 104/124 |
| 4,021,875 | 5/1977 | Abell et al. | 14/10 |
| 4,069,765 | 1/1978 | Müller | 104/123 |
| 4,163,498 | 8/1979 | Grooss et al. | 414/697 |
| 4,208,969 | 6/1980 | Baltensperger et al. | 104/111 |
| 4,264,996 | 5/1981 | Baltensperger et al. | 14/21 |
| 4,462,314 | 7/1984 | Kunczynski | 104/115 |
| 4,641,587 | 2/1987 | Dalliard | 105/3 |
| 4,665,830 | 5/1987 | Anderson et al. | 104/124 |
| 4,953,468 | 9/1990 | Creissels | 104/123 |
| 5,231,931 | 8/1993 | Sauvageot | 104/124 |

OTHER PUBLICATIONS

Aerobus By Parks, A Railroad In The Sky, Fred Parks, 4 pages, (no date).

Aerobus Vehicle Simulation, Videotape, Fred Parks, 1995.

Aerobus, Videotape, Fred Parks, 1988.

Aerobus Route Simulation, Videotape, Fred Parks, 1995.

20
18
12
18
10
28
18
16
14
20

28
16
26
14
26
28
16b
16a
14a
14b 14
14d
14c
26

FIG. 7Y
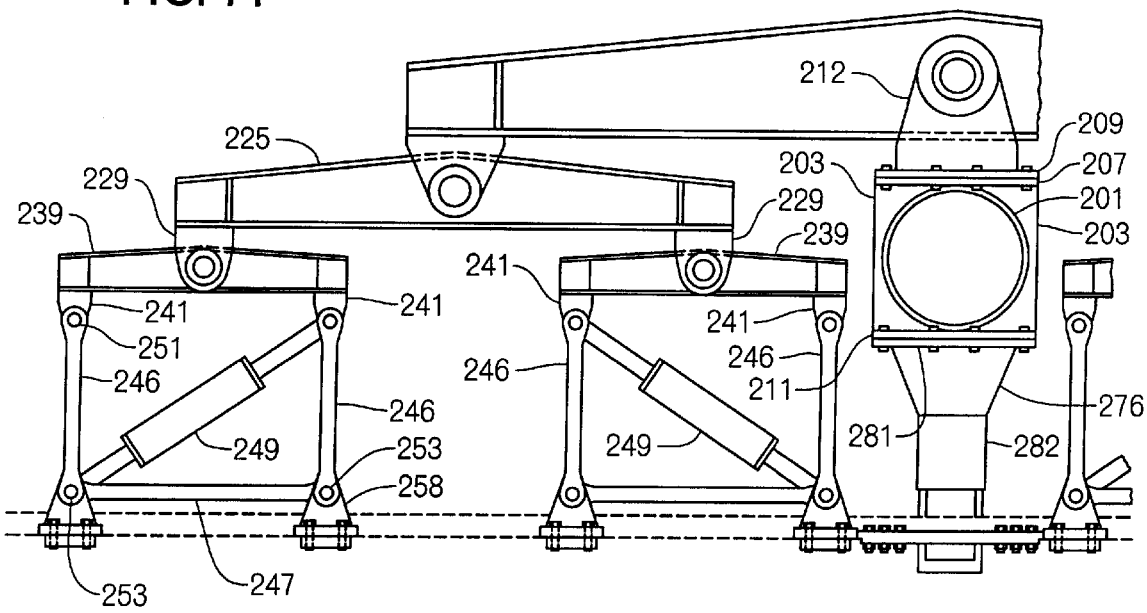
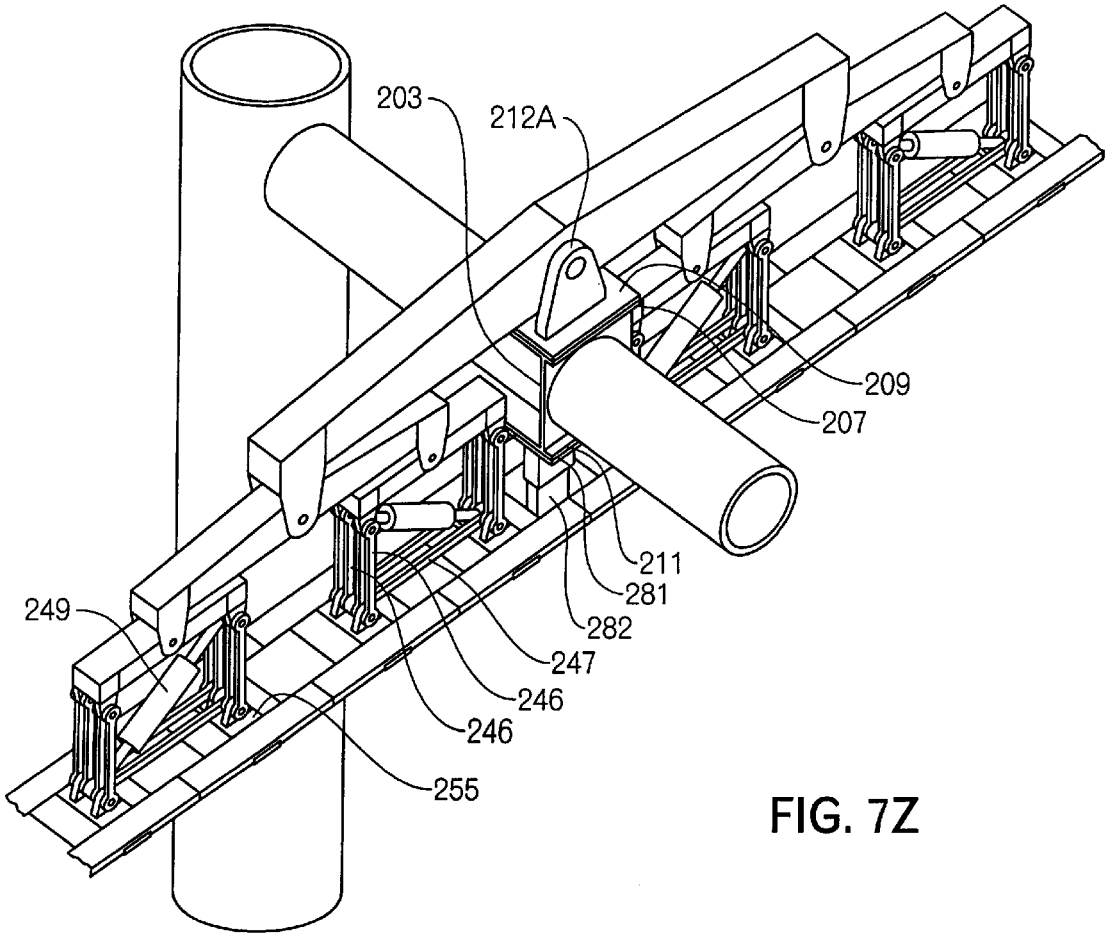
FIG. 7Z

FIG. 7AA
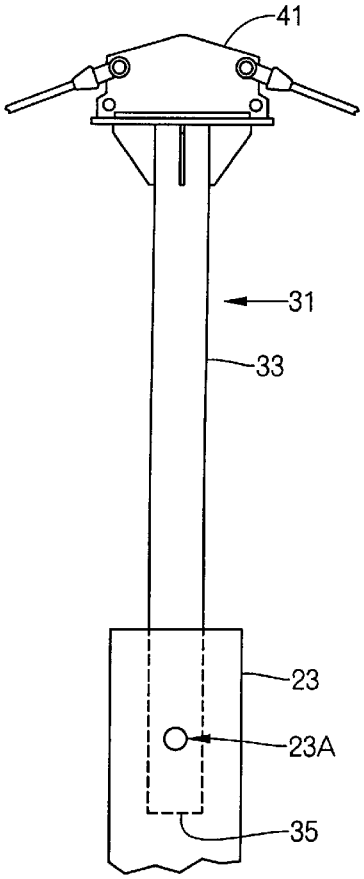
FIG. 7AB
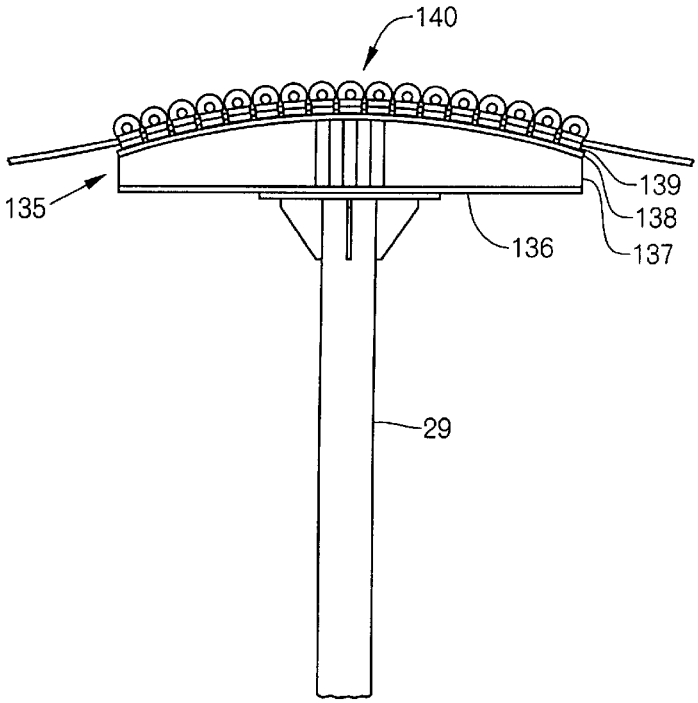
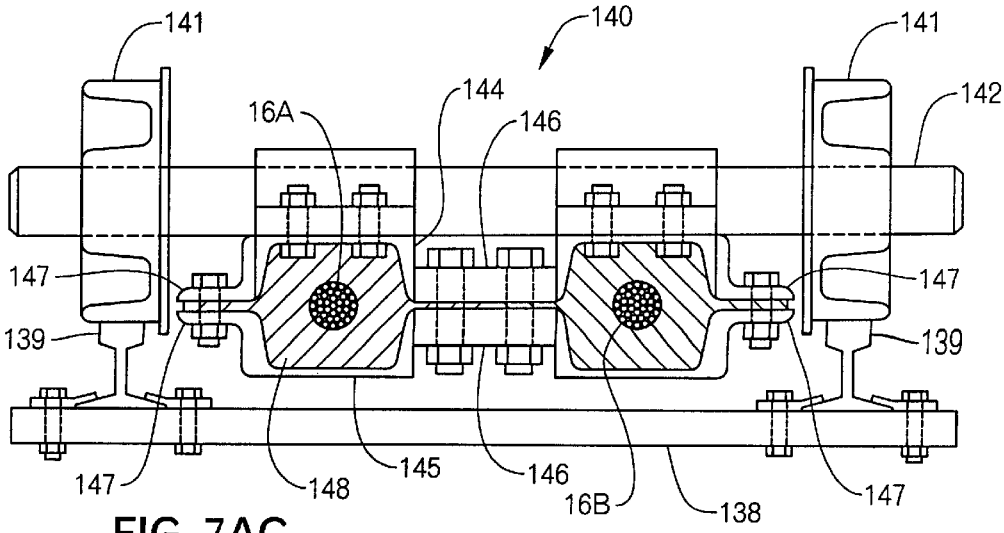
FIG. 7AC

FIG. 7AD
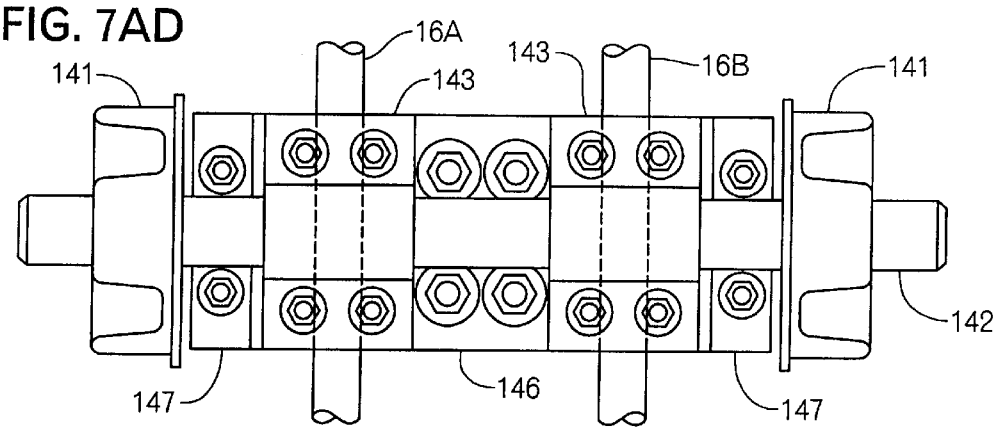
FIG. 7AE
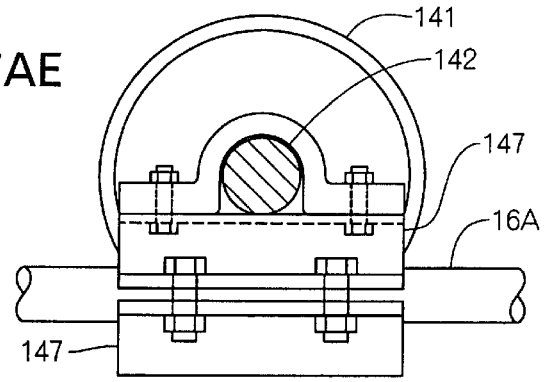
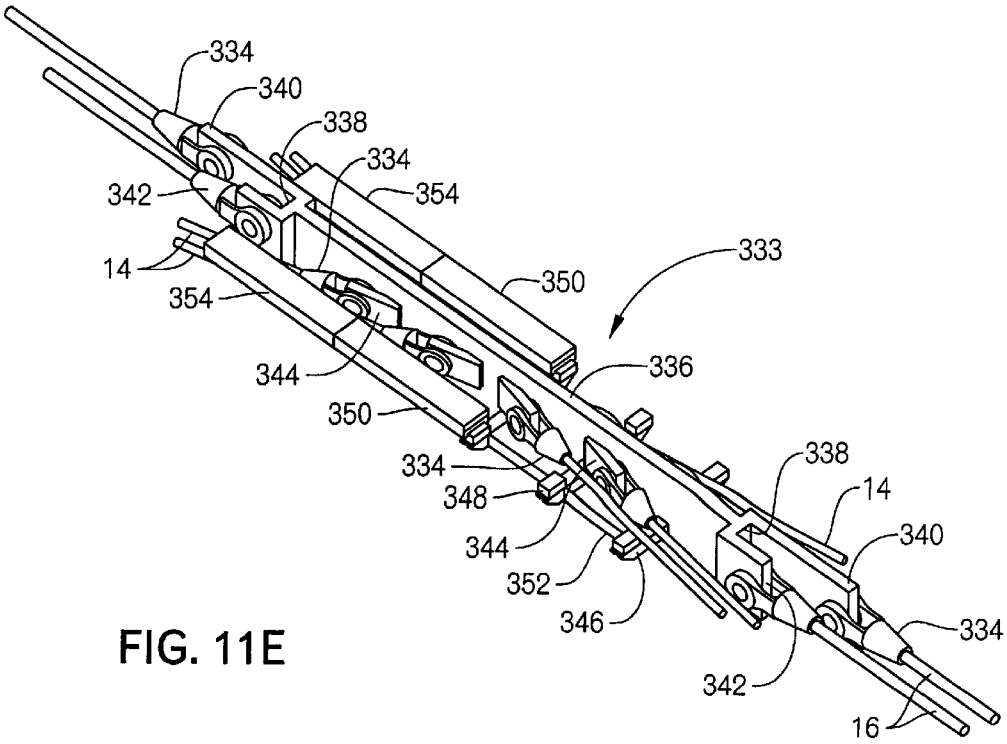
FIG. 11E

ELEVATED CABLEWAY SYSTEM

This application is a continuation-in-part of application Ser. No. 08/510,479, filed Aug. 2, 1995; now U.S. Pat. No. 5,720,225.

BACKGROUND OF THE INVENTION

1. Field of the Invention

This invention pertains to elevated cableway systems used in mass transit systems and the like, and, more particularly, to an improved cableway for such systems.

2. Description of the Prior Art

Many types of elevated cableway systems have been used in or proposed for mass transit systems. One such system is disclosed and claimed in U.S. Pat. No. 4,069,765 issued Jan. 24, 1978 to Gerhard Müller. This system is neither a suspension, or cable stayed bridge nor an aerial tramway. Consequently, not all standard design criteria are necessarily applicable to the system in the Müller '765 patent.

Thus the Müller '765 patent discloses a non-standard approach and FIGS. 1–5 of the present application correspond to FIGS. 3–7 of the Müller '765 patent. FIG. 1 illustrates in gross an elevated cableway system 10 in which vehicle 12 travels along track cable systems 14 suspended from catenary, or support cable 16. As shown in FIGS. 2–3 and 5, track cable systems 14 comprises locked-coil steel cables 14*a–d* and catenary cable system 16 comprises locked-coil steel cables 16*a–b*. Returning to FIG. 1, a plurality of pylons 18 elevate and support track cable systems 14 and catenary cable system 16 between the termini 20 of system 10. Track cable systems 14 and catenary cable system 16 are preferably anchored to ground 19 to sustain horizontal cable forces and transmit them to ground 19.

One of Müller's basic approaches is illustrated in FIGS. 1–2. Stress loads associated with the "sag" in track cable systems 14 and catenary cable system 16 caused by the weight of vehicle 12 were a problem for cableway systems at the time Müller filed the '765 patent application as shown in FIG. 1. Müller proposed, as disclosed in the '765 patent, to address these problems by pre-tensioning, or pre-stressing, track cable systems 14 so that track cable systems 14 levelled under the weight of vehicle 12 as shown in FIG. 1.

Part of Müller's proposed design included new cross-ties 15 and hangers, or spacers, 7 for suspending track cable systems 14 from catenary cable system 16. These cross-ties 15 and hangers 7, which were new at the time, are illustrated in FIGS. 2–3. Through this suspension system, track cable systems 14 were tensioned as described above and, consequently, "bowed" upward when not weighted by vehicle 12. This approach has worked well and is incorporated in the present invention as set forth below.

Müller also proposed tying track cable systems 14 and catenary cable system 16 together between pylons 18 at points 22 as shown in FIG. 4. Müller tied the cables with force equalization plate 24, in cooperation with clamping plate 26 and wedges 28. Force equalization plate 24 also improved the distribution of load stresses in the cableway system and, in combination with tensioning track cable systems 14, substantially advanced the art.

Müller also adopted the pylon structure earlier disclosed in U.S. Pat. No. 3,753,406. As set forth in column 1, line 65 to column 2, line 3 of the '765 patent, it was thought the pylons in such a system must be "stiff". It was though that "self-aligning" or "self-adjusting" pylons would introduce undesirable longitudinal shifting between the catenary and track cables. However, we now know that "self-aligning" or "self-adjusting" pylons produce substantial design benefits provided measures are taken to minimize or eliminate longitudinal shifting.

Some problems also appeared in implementing Müller's design despite its great advance over the art. For instance:

(1) catenary cable system 16 was strung over rollers on the top of pylons 18 and began to wear from the movement across the rollers as vehicle 12 traversed the cableway;

(2) the design of the equalizer plate 24 could also cause problems by kinking cable elements 16*a–b,* and 14*a–d,* under some circumstances; and (3) cable elements 14*a–d* were required to have upper surfaces engageable by the wheels of the vehicle because the equalizer plate did not provide for such engagement.

It further came to be realized that load stresses could be better distributed through redesign of the force equalizing assembly as well as the hangers and cross-ties, particularly in light of the new pylon designs.

U.S. Pat. No. 4,264,996 by Baltensperger and Pfister describes a suspended railway system with towers that support a catenary cable atop the towers and support track cables with a "stressing beam" that is pivotally connected to the towers. The '996 system is, however, distinguishably less capable than the present invention. For instance, the '996 patent fails to grasp the catenary cable at the support on top of the tower. Therefore, as described in the '996 patent, the cable is allowed to slip in the notches of the support. This slippage will inevitably cause wear on the cables.

Additionally, while the stressing beam gives some measure of weight redistribution at the track cable support, the fact that there is only one beam and the fact that the beam merely pivots about a single point ensures that the impact with the support of a vehicle passing over the support will not be substantially lessened. When weight is applied to one end of the beam, the other end of the beam necessarily must tilt upwardly thereby creating a ramp for a vehicle traversing the track to climb. With only a single beam, the tilt of the beam cannot be lessened until the vehicle passes each point along the beam. If the beam had secondary and tertiary beams connected to it as the present invention does, the moment about the central pivot point could be lessened in advance of the vehicle. With secondary and tertiary beams, the point of applied load is the point where the secondary beam attaches to the main beam, not the point the vehicle is passing.

It is therefore a feature of this invention that it provides an improved pylon design for elevated cableway systems.

It is furthermore a feature of this invention that the improved pylon design reduces wear on the catenary cable system by not allowing the catenary cable system to slide or role directly on the top of the pylon.

It is furthermore a feature of this invention that the improved pylon includes a new, deflecting upper saddle to support the catenary cable system while relieving stresses imposed on the catenary cable system by deflecting under load applied by the vehicle traversing the track cable system.

It is a still further feature of this invention that the improved pylon includes an improved, pivotable lower saddle to better transmit forces and distribute load stresses through the cableway system as the vehicle traverses the cableway.

It is furthermore a feature of this invention that load stresses are distributed through improved hanger and spacer designs.

It is still furthermore a feature of this invention that it provides an improved cableway system with greater lateral support for the union between the catenary and track cable systems by providing improved force equalizing assemblies.

It is still furthermore a feature of this invention that it provides an alternate force equalizing assembly that reduces wear on the catenary cable system and the track cable systems by allowing the cables to controllably yield relative to one another as force is transferred between them.

SUMMARY OF THE INVENTION

The features described above, as well as other features and advantages, are provided by an improved cableway system that includes a pylon, an upper saddle, and a lower saddle. The pylon includes a base pylon, and the lower saddle is mounted to the base pylon from which a track cable may be strung. The upper saddle, from which a catenary cable system may be strung, is movably mounted to the base pylon to deflect in response to the weight of a vehicle traversing the track cable systems.

The improved pylon also includes in some embodiments a new lower saddle including a main beam pivotally mounted at the center of its longitudinal axis to the pylon for rotation in a first vertical plane. A pair of secondary beams are each pivotally mounted at the center of its longitudinal axis to the main beam substantially at a respective end of the main beam for rotation in the first vertical plane. Four tertiary beams are each pivotally mounted at the center of its longitudinal axis to one of the respective secondary beams substantially at a respective end of the one secondary beam for rotation in the first vertical plane. Eight suspension rods are each pivotally mounted at one of its ends to one of the respective tertiary beams substantially at a respective end of the one tertiary beam for rotation in the first vertical plane. The other end of each suspension rod is pivotally connected to a cross-tie at the center of the cross-tie's longitudinal axis for rotation of the cross-tie in a second vertical plane that is perpendicular to the first vertical plane. The cross-tie supports the second cable. Four shock absorbers are each pivotally mounted at one of its ends to one of the respective tertiary beams, and the other end of each shock absorber is pivotally connected to a cross-tie near another end of a suspension rod that is connected substantially at the other end of the tertiary beam to which the one end of the shock absorber is connected. Four bracing rods are each pivotally mounted at one of its ends to a cross-tie near a lower end of a first suspension rod. Another end of each bracing rod is pivotally connected to a cross-tie at a lower end of and near a second suspension rod that is connected to an opposite end of a tertiary beam from which the first suspension rod hangs.

The improved cableway system also includes improved hangers and cross-ties comprising a hanger member suspended from the catenary cable system by one end thereof. A cross-tie is pivotably mounted to the hanger member at the end distal to the catenary cable system. A track cable guide is affixed to the cross-tie, and a power rail guide is mounted to the cross-tie.

A force equalizing assembly for joining the catenary cable system to the track cable systems midway between the pylons is also provided to equalize the tension between the support and track cable systems. The assembly includes a force equalization plate having at least three parallel channels formed along the length of a surface thereof is provided for accepting the support cable in the center channel and the track cable systems in the outer channels. The channels are shaped to approximate one-half of the respective cable circumferences, except that the ends of the channels are flared outwardly. The channeled clamping plate has at least three parallel channels formed along the length of a first surface thereof is provided for accepting the support cable in the center channel and the track cable systems in the outer channels. The channels of the clamping plate are shaped to approximate one-half of the respective cable circumferences, except that the ends of the channels are flared outwardly. The channeled clamping plate has a second surface opposite the first surface that is adapted for engagement by the wheels of the cable car. The channeled surfaces of the force equalization plate and the clamping plate are complementary such that the plates may be assembled about the cables for frictionally locking the cables within the respective channels to equalize the tension in the support and track cable systems. The respective flared ends of the channels in the assembled plates form a frusto-conical cavity in each end of the assembly about each of the cables for reducing wear on the cables by the ends of the plates.

In another improved embodiment of the force equalizing assembly, the cables of the catenary cable system and the track cable systems are grasped about their circumferences by cable connections of a system of cable encasing members. The cables are thereby connected through the cable connections to a frame of the system of cable encasing members for distributing forces among the cable systems. The force equalizing assembly is adapted to accept connection of cables both from angles acute to and parallel with the longitudinal axis of the frame.

In another improved embodiment of the force equalizing assembly, a catenary cable system clamp grasps the catenary cable system and a plurality of track cable system clamps grasp the pair of track cable systems. The track cable system clamps are yieldably attached to the catenary cable system clamp to provided controlled force distribution between the cable systems. The top surface of the plurality of track cable system clamps is adapted for engagement by the wheels of a vehicle traversing the elevated cableway system.

BRIEF DESCRIPTION OF THE DRAWINGS

A more particular description of the invention briefly summarized above can be had by reference to the preferred embodiments illustrated in the drawings in this specification so that the manner in which the above cited features, as well as others that will become apparent, are obtained and can be understood in detail. The drawings illustrate only preferred embodiments of the invention and are not to be considered limiting of its scope as the invention will admit to other equally effective embodiments. In the drawings:

FIG. 7A is a side, elevation view; FIG. 7B is a broken isometric view; FIGS. 7C–D are elevation and plan views, respectively, of the base of the upper saddle in partial section.

7H.

FIG. 7M is a partial elevation view; FIG. 7N is a side elevation view taken along section 7N—7N in FIG. 7M; FIG. 7P is a partial plan view of FIG. 7M.

FIG. 7R is an elevation view; FIG. 7S is a side elevation view taken along section 7S—7S in FIG. 7R; FIG. 7T is a side elevation view taken along section 7T—7T in FIG. 7R; FIG. 7U is a plan view taken along section 7U—7U in FIG. 7R.

FIG. 7V is an elevation view; FIG. 7W is a plan view of FIG. 7V; FIG. 7X is a side elevation view taken along section 7X—7X in FIG. 7W.

FIG. 7Y is a side elevation view of an alternate embodiment of the lower saddle connected to a tubular pylon support beam with stabilizing shock absorber and bracing rods added. FIG. 7Z is a partial isometric view of the alternate embodiment of the lower saddle connected to a tubular pylon support beam.

FIG. 7AA is a side elevation view of a support pylon showing an upper saddle supported by a tubular base pylon that has an opening in an upper end through which a lower end of an upright extends.

FIGS. 7AB–7AE illustrate an alternate upper saddle that supports a catenary cable on top of a base pylon through a set of cable clamping wheel assemblies; FIG. 7AB is a side elevation view of the alternate upper saddle mounted on top of a base pylon; FIG. 7AC is an end elevation view of one of the cable clamping wheel assemblies supported atop a roller base and wheel bearing members; FIG. 7AD is a plan view of one of the cable clamping wheel assemblies; FIG. 7AE is a side elevation view of one of the cable clamping wheel assemblies.

FIG. 8A in partially exploded perspective and FIG. 8B is in elevation.

FIG. 9A shows a horizontal section of the catenary cable system; and FIG. 9B shows an inclined section of the catenary cable system.

FIG. 10A in a top view with ghosted lines; FIG. 10B in section along line 10B—10B in FIG. 10A and in partial cutaway; and FIG. 10C in an end view.

FIG. 11E shows an isometric view of an alternate force equalizing assembly.

FIG. 11F shows an isometric view of the second alternate force equalizing assembly; FIG. 11G shows a cross-section through a middle portion of the force equalizing assembly; FIG. 11H is a cross-section taken along line A—A as shown in FIG. 11G; FIG. 11I is a cross-section taken along line B—B as shown in FIG. 11G; FIG. 11J is a plan view of a portion of the force equalizing assembly; FIG. 11K is a cross-section taken along line C—C as shown in FIG. 11J; FIG. 11L shows an end elevation view of the second alternate force equalizing assembly.

DESCRIPTION OF THE PREFERRED EMBODIMENT

Figure 6:
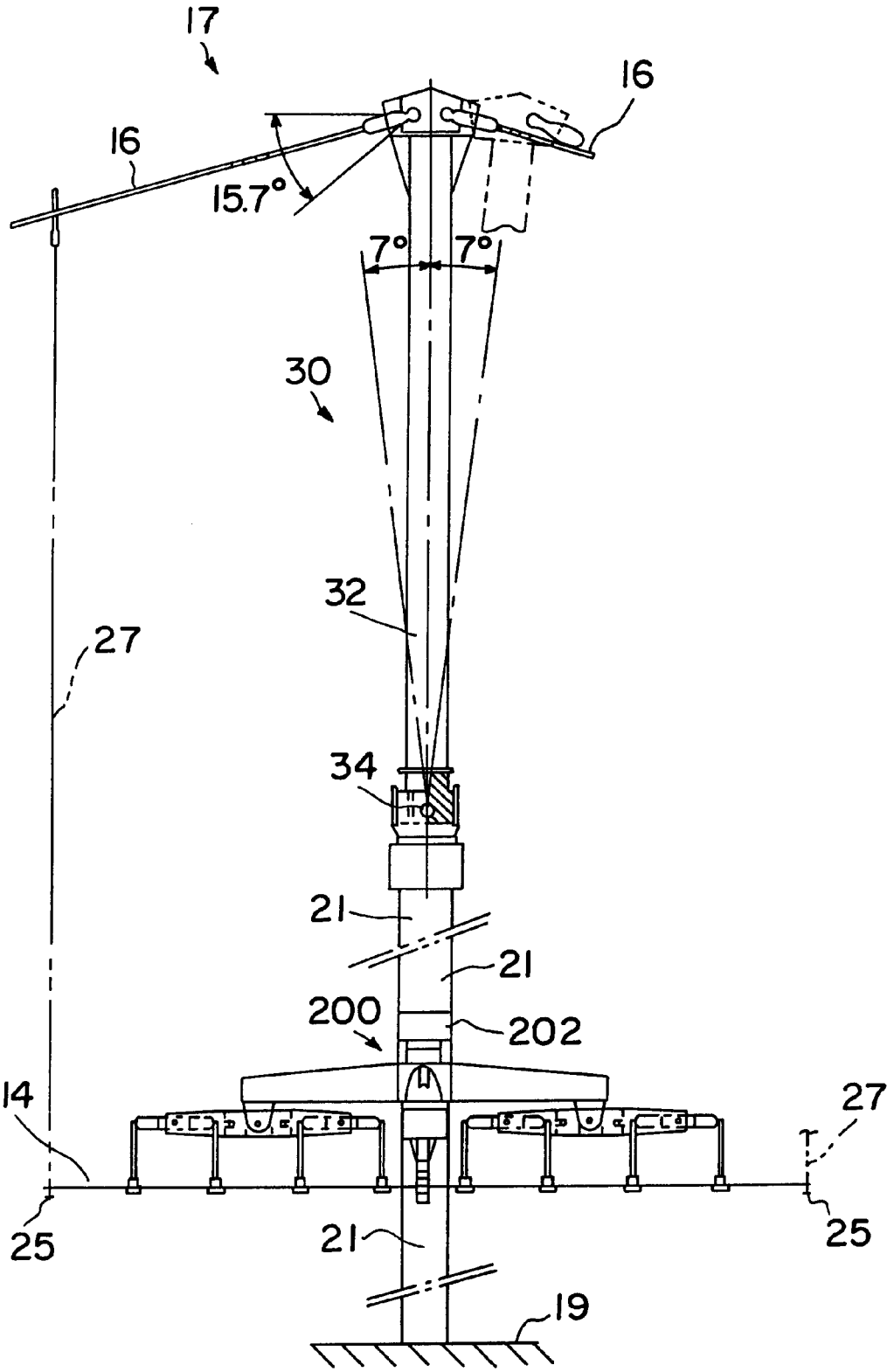
FIG. 6 illustrates the pylon of the inventive cableway system described herein, including an upper saddle and a lower saddle, in elevation.

FIG. 6 illustrates one of pylons 17 in a preferred embodiment of the elevated cableway system, including upper saddle 30 from which catenary cable system 16 is strung, lower saddle 200 from which track cable systems 14 are strung, and base pylon 21 on which lower saddle 200 is mounted. Hangers 27 suspend track cable systems 14 from catenary cable system 16 and pre-tension track cable systems 14, as described above. Pylon 17 is attached to ground 19 by any suitable technique known to the art. The precise dimensions of pylon 17 such as height and width will be matters of engineering design predicated on well known structural principles to account for structural loads, such as vehicle and cable weight, and for loads arising from environmental conditions such as wind, seismic activity, precipitation and temperature.

Figure 7A:
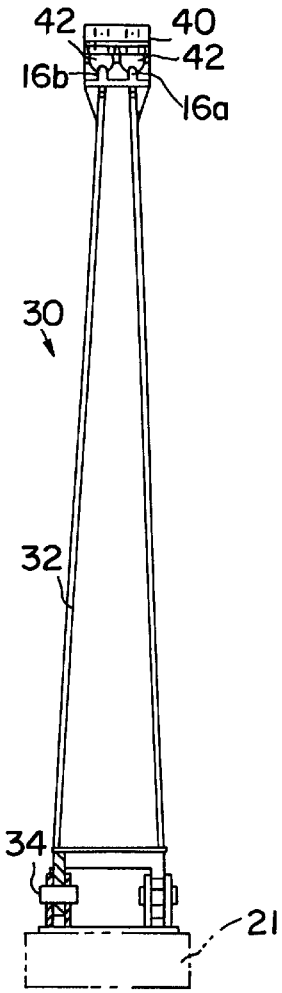
FIGS. 7A–G illustrate the upper saddle of the new pylon.
Figure 7E:
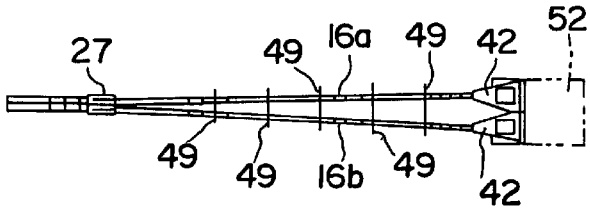
Figure 7F:
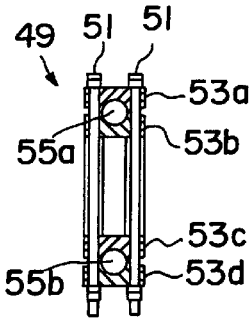
Figure 7G:
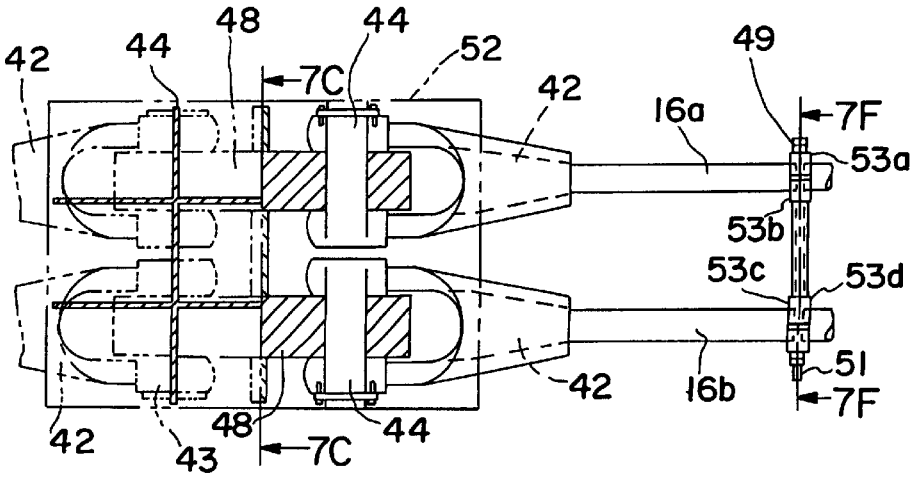
Figure 7B:
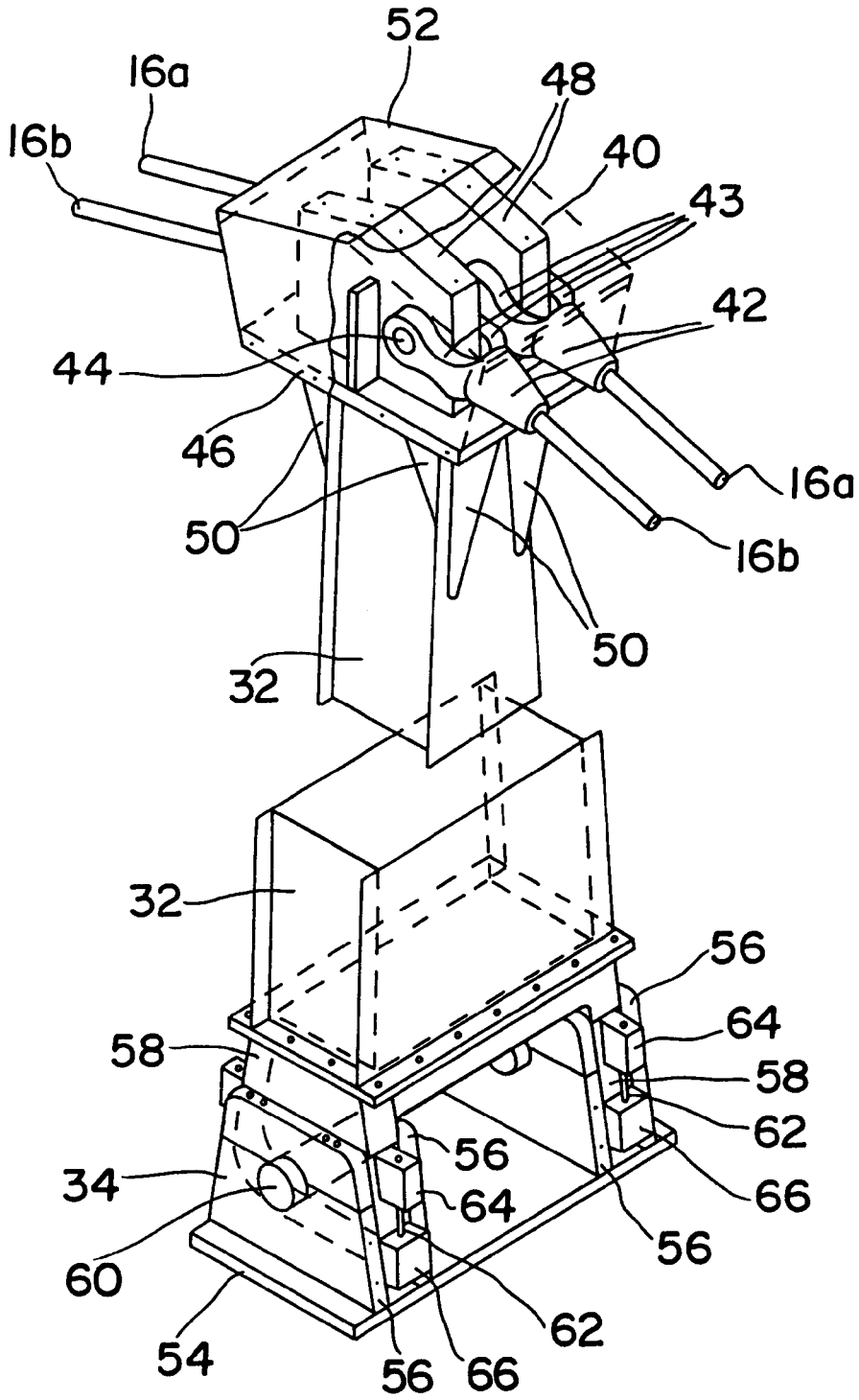
Figure 7C:
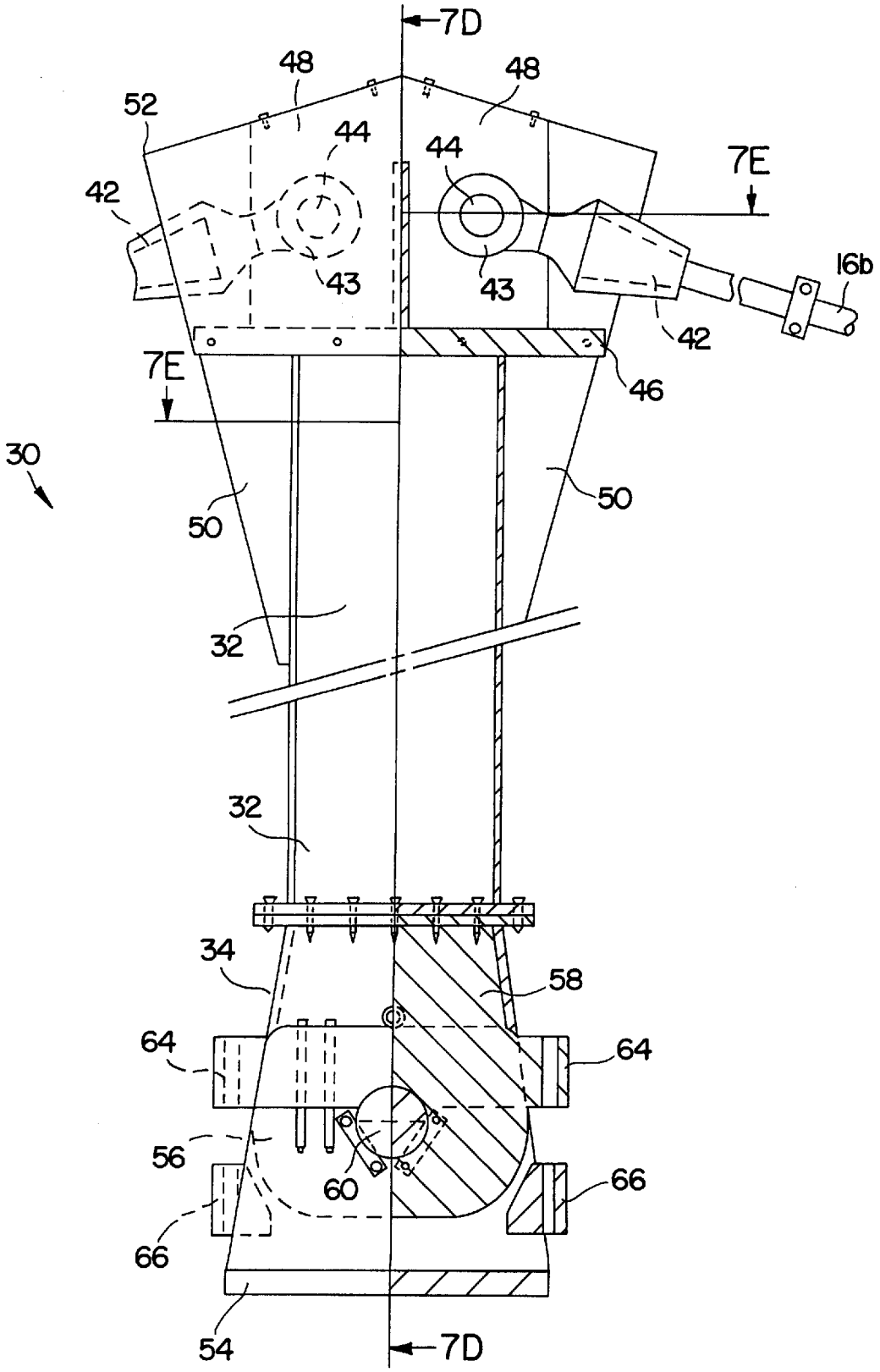
Figure 7D:
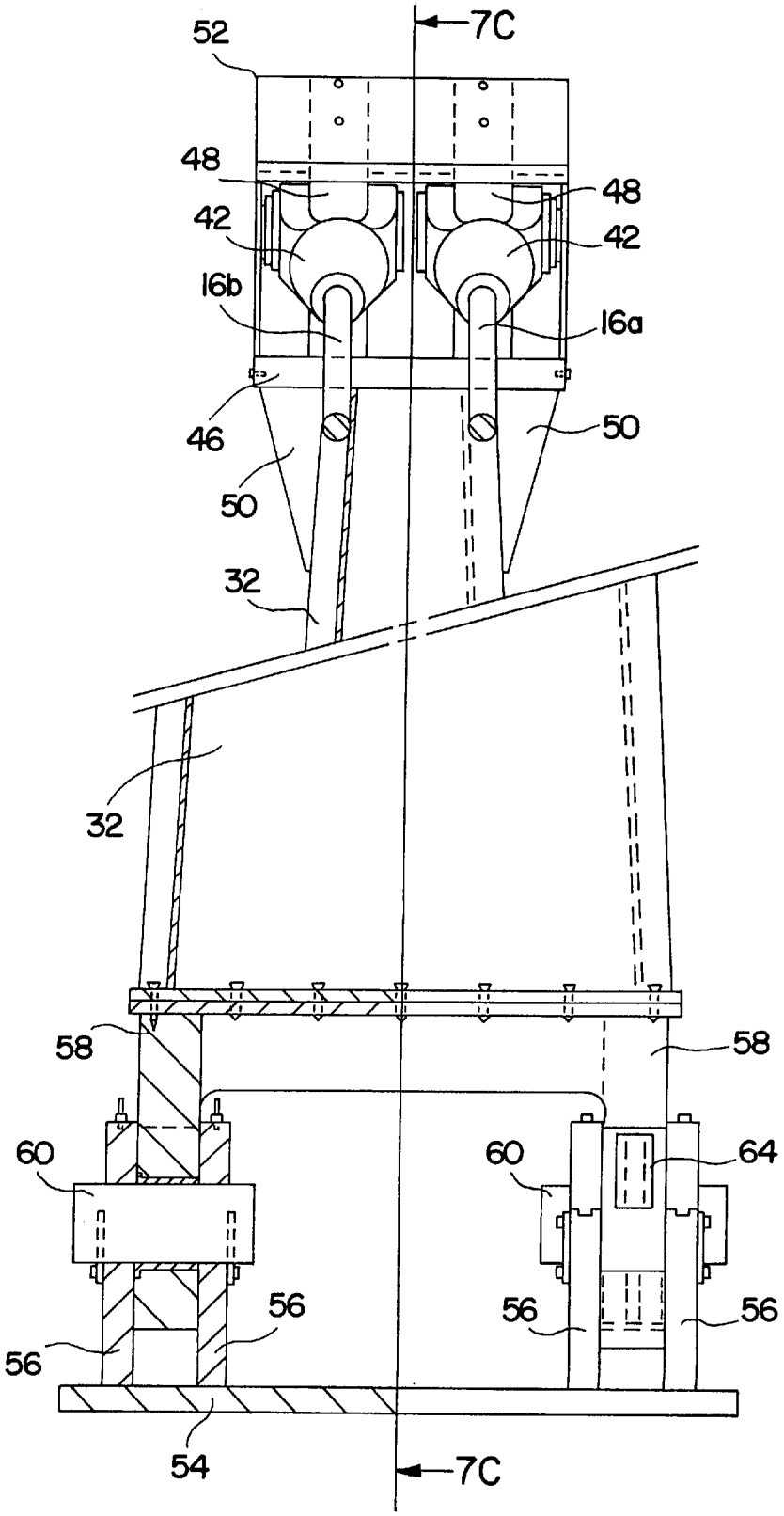

Upper saddle 30, shown in greater detail in FIGS. 7A–C, permits relatively free motion at the top of pylon 17, and transmits vertical loads from vehicle 12 and pre-tensioning forces to pylon 17. Upper saddle 30 lessens fatigue of catenary cable system 16, requires only limited maintenance, and eases implementation of a desired 7° deviation of pylon 17. Upper saddle 30 comprises upright 32 pivotably mounted to base 34 and is capped by coupling 40, which is engaged with cable connector 42.

Turning now to FIG. 7B, coupling 40, cable connector 42, and pin 44 atop upper saddle 30 are shown in an enlarged, partially cutaway view. Supports 50 help bear and distribute the load on coupling 40 to upright 32. Cover 52 provides some protection for coupling 40 and connector 42 from the elements. The socketing and pinned connection of coupling 40 engaged with cable connector 42 reduces the risk of fatigue to catenary cable system 16 caused by the shifting of catenary cable system 16 across pylon 18 of the system in the Müller '765 patent. The embodiment of FIGS. 7A–C thereby reduces the risk of fatigue failure in catenary cable system 16 by precluding bending fatigue stresses, thus leaving only tension-tension fatigue stress on catenary cable system 16. This connection also permits shorter cable lengths to facilitate transportation, handling and construction of the system.

Coupling 40 in the preferred embodiment is a welded plate assembly including base plate 46 and at least two member plates 48 extending substantially perpendicularly from base plate 46 as shown in FIG. 7B. Cable connector 42 is socketed on one end to engage coupling 40. Pin 44 joins cable connector 42 to coupling 40 through co-aligned holes in tines 43 of forked connector 42 and coupling 40 when cable connector 42 and coupling 40 are engaged. The socket and pin connection provided by cable connector 42 must be strong enough to sustain the load on catenary cable system 16 and the loads from environmental conditions. Cables 16*a–b* are strung in a first direction from the non-connected end of cable connector 42. Coupling 40 is also joined to a second cable connector 42 that provides cable connection to cables 16*a–b* in a second direction, as shown in FIG. 7B.

Cables 16*a–b* are preferably clamped together as shown in FIG. 7E at predetermined intervals using clamps 49 between cable connector 42 and the first one of hangers 27. Clamps 49 are better illustrated in FIGS. 7F–G and comprise pins 51 joining clamp members 53*a–d*. Clamp members 53*a–d* define passages 55*a–b* through which cable members 16*a–b* pass.

Figure 10A:
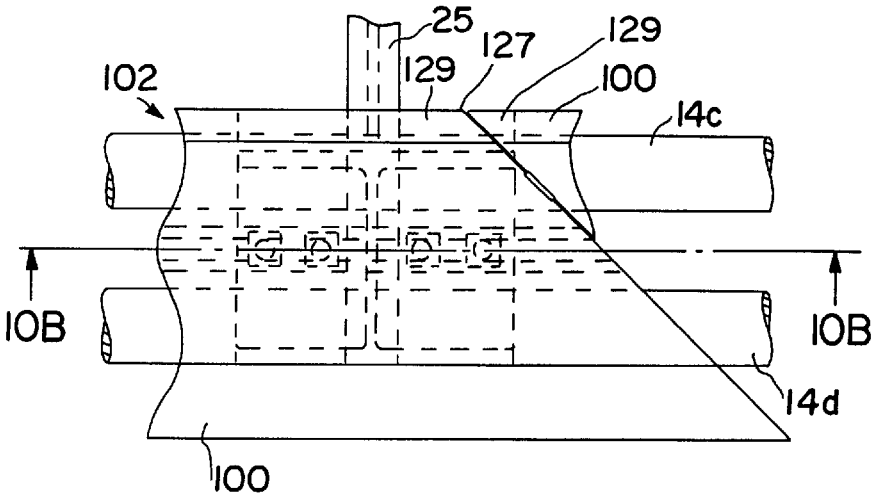
FIGS. 10A–C illustrate the cross-ties, cables, and rails of the track cable systems in the new system.
Figure 10B:
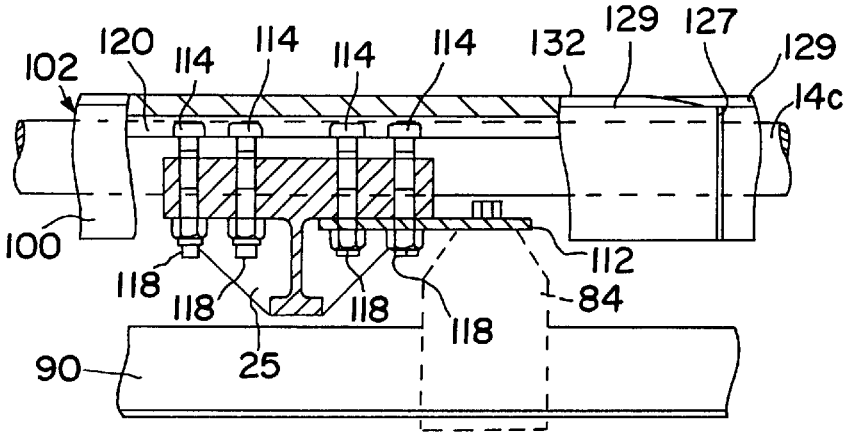
Figure 10C:
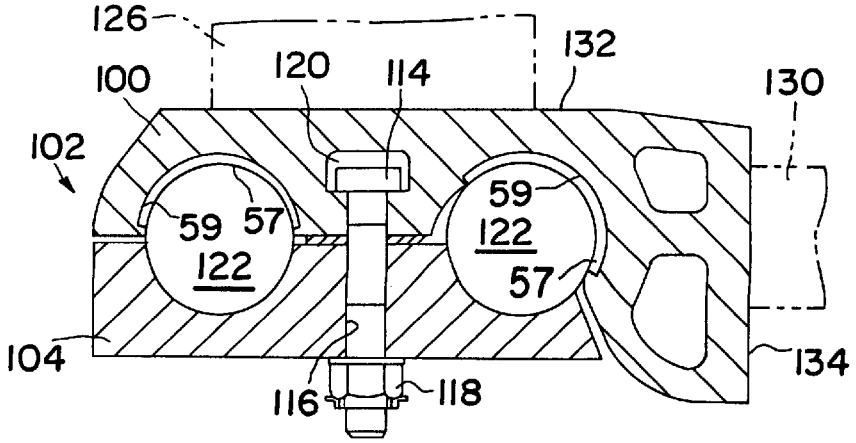

Passages 55*a–b* may include flared openings on one or both ends thereof as are discussed in connection with catenary cable clamp 85 and equalizing lock 300. The flared openings of passages 55*a–b* are best shown in FIG. 10C, wherein the lesser diameter at point 57 of passages 55*a–b* forms the throat of the opening and the greater diameter at point 59 forms the flare. These flared openings minimize the "beam effect" wherein a clamped cable behaves structurally as a beam.

Still referring to the FIG. 7B, upright 32 is pivotably mounted to double V-shaped base 34. Base 34, like coupling 40, in the preferred embodiment is a welded plate assembly and comprises bottom plate 54 and side plates 56. Side plates 56 are attached in slotted channels at each end of bottom plate 54, as shown in FIG. 7C to define slots into which tongues 58 extend from the bottom of upright 32. Pins 60, preferably constructed from brass to reduce friction, run through co-aligned holes in side plates 56 and tongues 58. Upright 32 supports forces received through coupling 40 and transmits them to pins 60 about which upright 32 rotates.

Base 34 also includes additional means for bearing the load of upright 32. Each of these means includes a bearing pin 62 extending through a split flanged sleeve 64 and 66. Flanged sleeves 64 extend from tongues 58, and flanged sleeves 66 are welded to the interior surfaces of paired side plates 56. Bearing pin 62 is held in place by threaded nuts about pin 62 both above and below sleeve 64, and reciprocates in sleeve 66. The design of upper saddle 30 described above essentially implements a "pulley". Pins 60 are the center of rotation for this "pulley" and the length of upright 32 defines its radius. The "pulley" diameter may be variable and, in the preferred embodiment, is 150 times the diameter of catenary cable system 16. Although the design handles forces conceptually as does a pulley, there are obvious structural differences. For instance, rotation of upright 32 about pins 60 is constrained to a 7° deviation from the vertical norm. This rotation in upper saddle 30 prevents the introduction of high moments to pylon that are 17 present for the rigid pylons 18 of the system disclosed in the Müller '765 patent.

In the preferred embodiment, lower saddle 200 is designed to accommodate deflection of upright 32, and transmit the vertical and lateral loads applied across a portion of track cable systems 14 to pylon 17, which ultimately transmits the loads to the ground. In this manner, the lower saddle transmits loads developed by vehicle 12, cables 14, the environmental conditions, and deviation of upper saddle 30 (up to 7 degrees each direction). Furthermore, lower saddle 200 provides for a smoother transition from one pylon span to another than previously available, and increases the comfort of the vehicle's passengers by reducing the curvature of track cable systems 14.

Figure 7H:
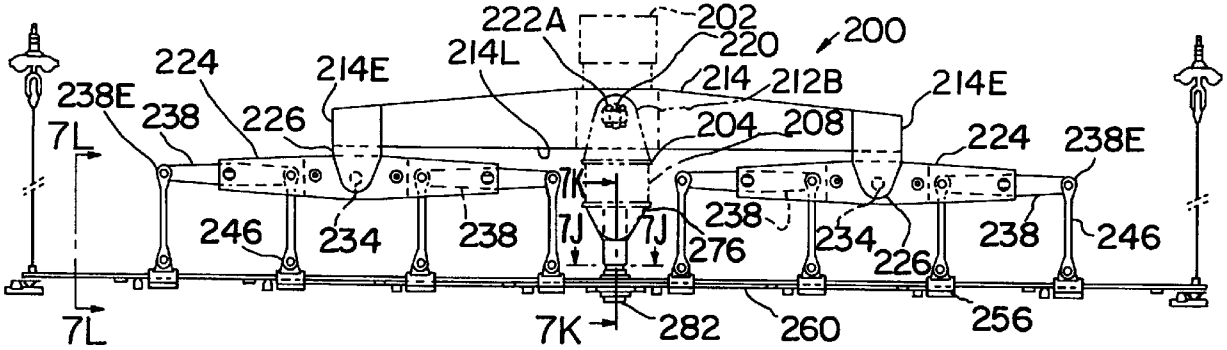
FIG. 7H illustrates an elevation view of the lower saddle of the pylon in FIG. 6.
Figure 7I:
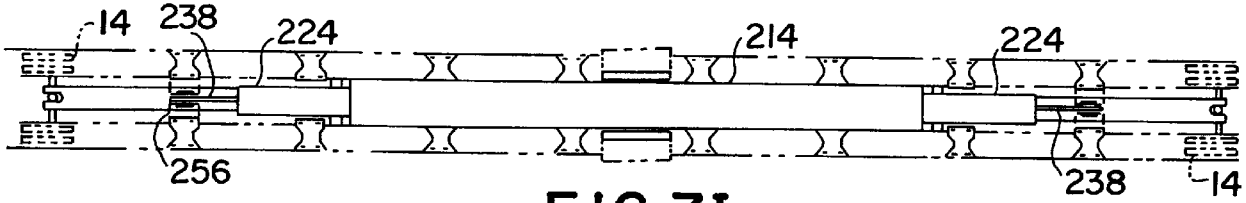
FIG. 7I is a plan view of FIG. 7H.
Figure 7K:
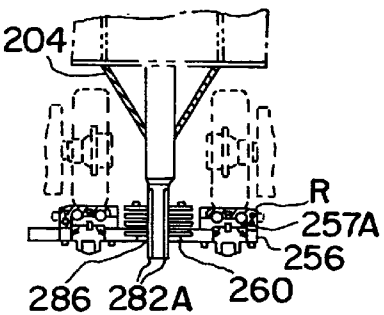
FIG. 7K is an elevation view taken along section 7K—7K in FIG. 7H.
Figure 7J:
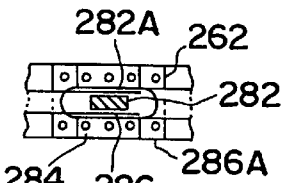
FIG. 7J is a plan view taken along section 7J—7J in FIG.
Figure 7L:
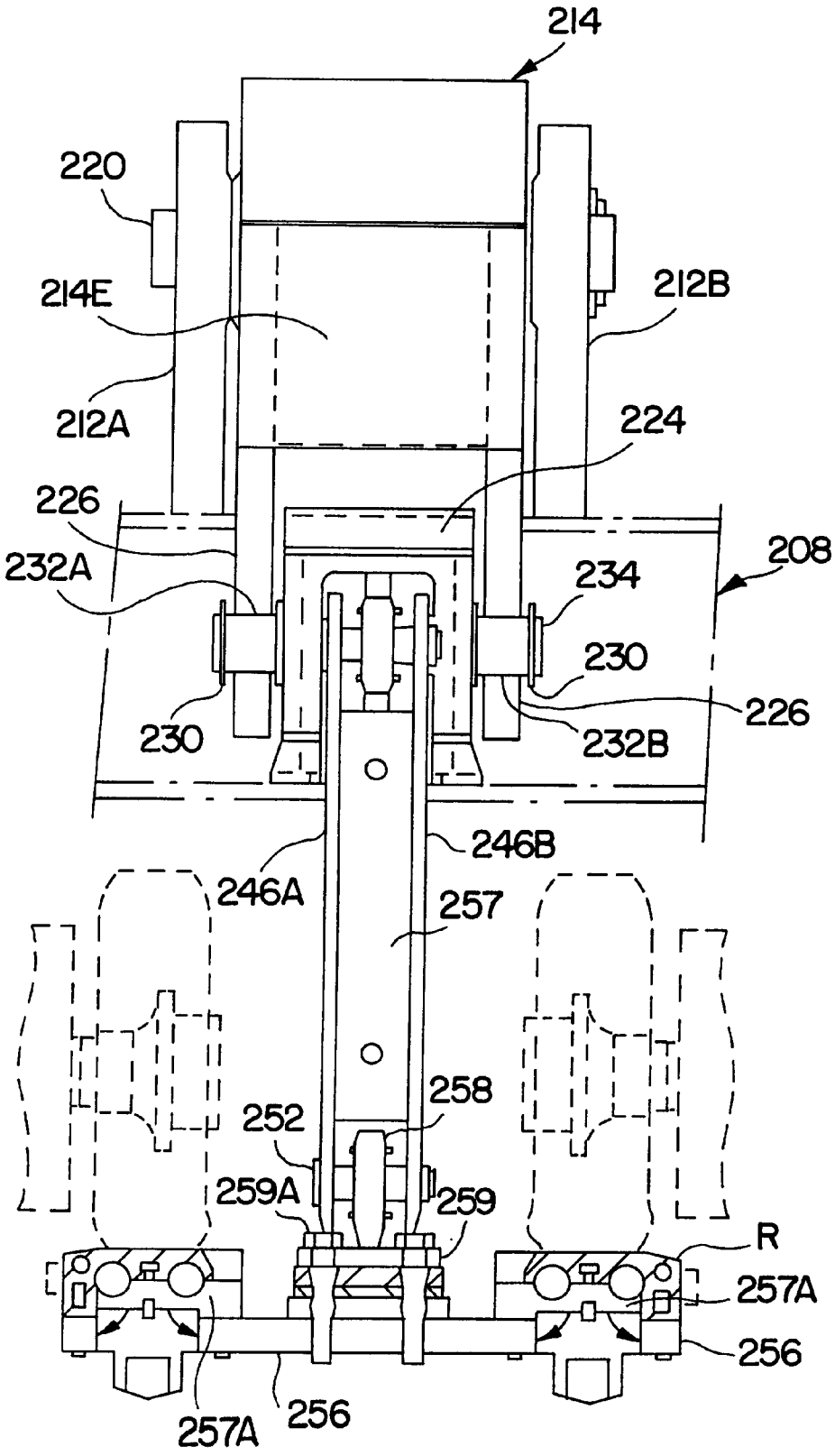
FIG. 7L is an elevation view taken along 7L—7L in FIG. 7H.
Figure 7N:
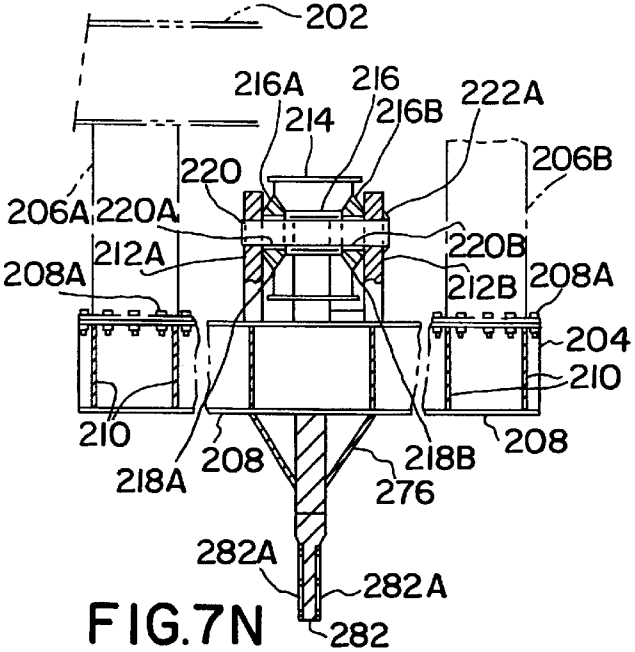
FIGS. 7M–N and 7P illustrate the transverse connecting frame and main beam of the lower saddle.
Figure 7Q:
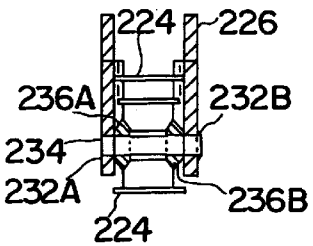
FIG. 7Q is an elevation view taken along section line 7Q—7Q of FIG. 7M.
Figure 7M:
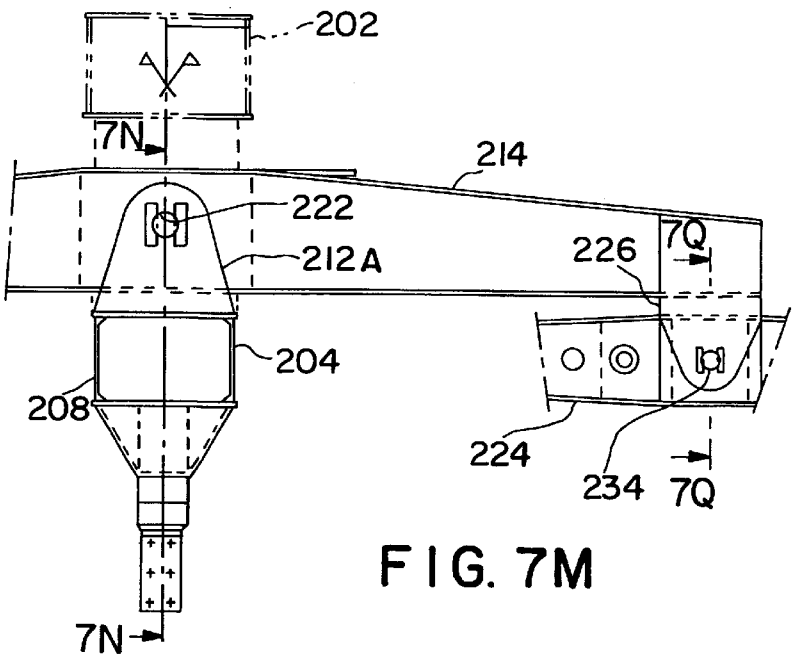
Figure 7P:
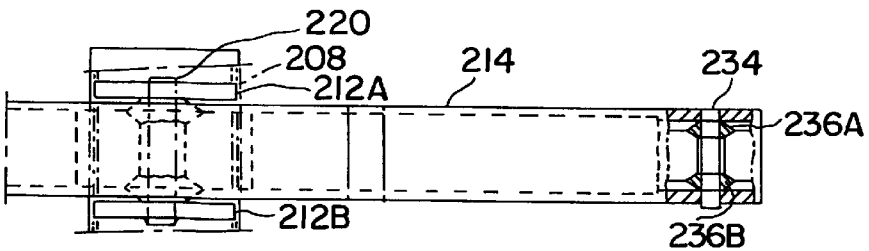
Figure 7T:
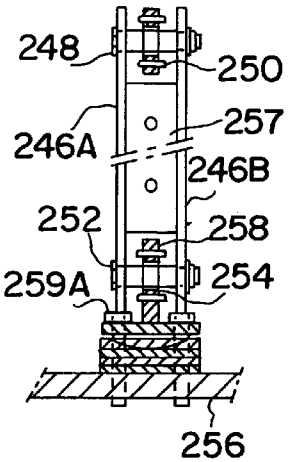
FIGS. 7R–7U illustrate the tertiary beams and suspension rod/cross tie assemblies of the lower saddle.
Figure 7S:
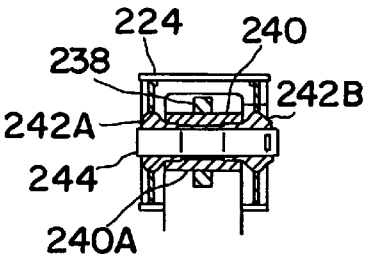
Figure 7R:
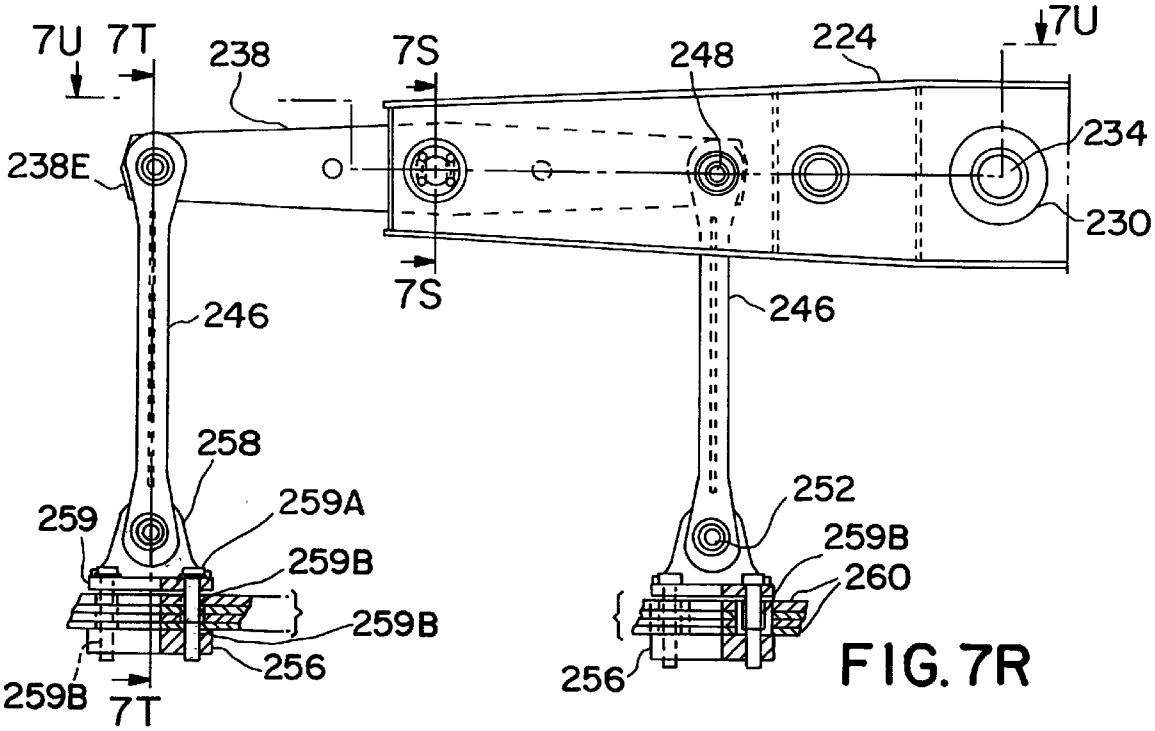
Figure 7U:
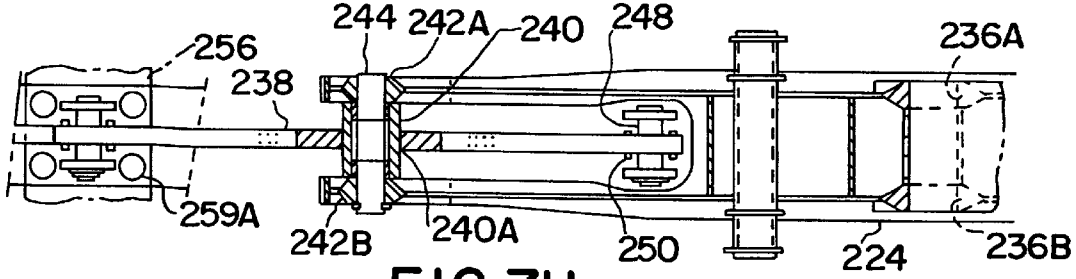
Figure 7V:
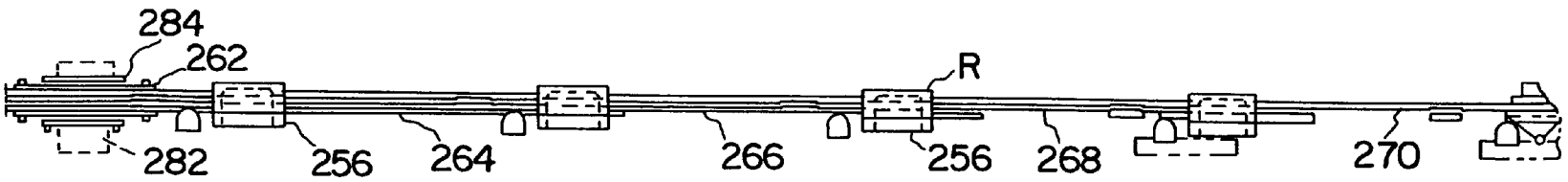
FIGS. 7V–7X illustrate the equalizing beam of the lower saddle.
Figure 7W:
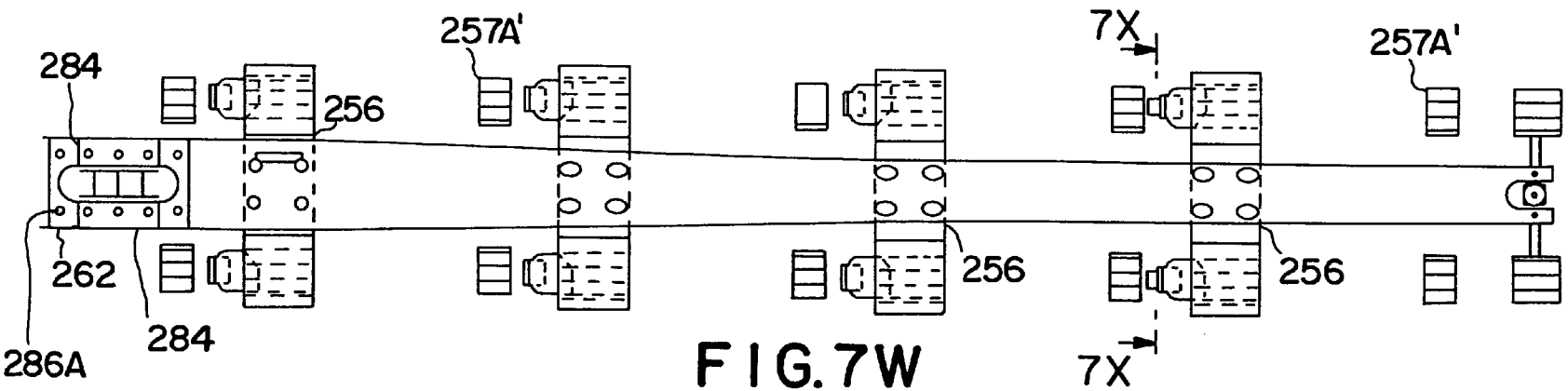
Figure 7X:
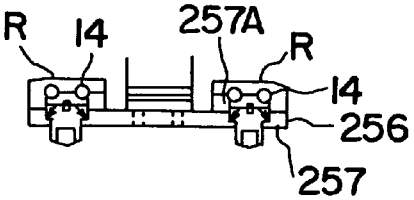

Lower saddle 200, represented in detail by FIGS. 7H–7X, is connected to pylon base 21 beneath pylon upright 32 by way of transverse pylon beam 202, that is mounted transversely to and extends outwardly from either side of base pylon 21. This connection between the lower saddle and pylon base 21 is also illustrated in FIG. 6.

U-shaped transverse connecting frame 204 is connected to one end of transverse pylon beam 202 and extends downwardly therefrom to accept and transmit lateral and vertical forces to pylon 17. A second identical transverse connecting frame extends downwardly from the other end of transverse pylon beam 202, providing a second guideway on the other side of each pylon, but only one such frame 204 will be discussed herein to avoid redundancy. With reference to FIGS. 7M and 7N, transverse connecting frame 204 includes two vertical suspension beams 206A, 206B connected to transverse pylon beam 202 and extending downwardly therefrom. Suspension beams 206A and 206B are connected by horizontally positioned transverse beam 208 by way of bolted connections 208A. Webs 210 are welded to and extend vertically across transverse support beam 208 for added stability. Bearing plates 212A and 212B are welded to and extend upwardly from transverse support beam 208. The assembly of the horizontal and vertical beams, and other associated hardware thus forms the structural skeleton of transverse connecting frame 204.

An alternate means of connecting a lower saddle to a base pylon beam 201, functionally similar to support beam 208 described above, is illustrated in FIGS. 7Y and 7Z. At least one pair of connecting plates 203 is attached to the base pylon beam to substantially encase the base pylon beam. Cap plate 207 is connected to the top of connecting plates 203. An upper attachment plate 209 is removably connected to cap plate 207 by a plurality of bolts. The attachment plate is fixed to bearing plates 212A and 212B in a manner similar to the attachment of bearing plates 212A and 212B to the transverse support beam described above. A hanger plate 211 is connected to the bottom of connecting plates 203. The hanger plate is fitted with holes to accept bolts to removably connect additional structure as described below.

A vertical load transmission system is pivotally connected to transverse connecting frame 204, shown in FIG. 7M, or alternatively to base pylon beam 201, shown in FIG. 7Y, for transmitting vertical loads developed by the vehicle and cables, as well as those loads developed by deflection of the upper saddle, to base pylon 21. A primary requirement of the vertical load transmission system is that vertical loads transmitted by the system should be well distributed over a portion of the track cable systems to avoid damaging curvilinear deflections in the cables. Accordingly, the vertical load transmission system is preferably an isostatic system of interconnected beams and bars arranged in a hierarchical manner.

More specifically, with reference to FIGS. 7H and 7L, main beam 214 is a welded plate assembly formed in rectangular cross-section, and is pivotally mounted through its side walls at the center of its longitudinal axis to bearing plates 212A and 212B for rotation in a vertical plane. Main beam 214 is bi-symmetrical and has a variable height defined by a sloped upper surface that peaks at its center directly above its pivotal mounting point and slopes downwardly towards its ends 214E. Lower surface 214L of the main beam is flat and extends horizontally between ends 214E.

Dumbbell-shaped collar 216 is mounted at its disc-like ends 216A and 216B across the sides of the main beam in circular openings 218A and 218B, respectively, as shown in FIGS. 7N. Shaft 220 is mounted through the longitudinal axis of collar 216 and extends out of ends 216A, 216B through cylindrical openings 220A and 220B therein, respectively. The ends of shaft 220 further extend through openings 222 and associated radial bearings 222A in bearing plates 212A and 212B of the transverse connecting frame, as indicated in FIGS. 7H and 7N, thereby supporting the main beam for rotation relative to the pylon. Bearings 222A are bronze to reduce friction.

A pair of secondary beams 224 are pivotally mounted at the centers of their respective longitudinal axes to flanges 226 connected to and extending downwardly from locations near the respective ends 214E of the main beam, enabling rotation of the secondary beams relative to the main beam in the same vertical plane that the main beam is rotatable within. Flanges 226 are equipped with openings 232A and 232B, respectively, for mounting shafts 234 therein, as displayed in FIGS. 7L and 7Q. Shafts 234 pass through discs 236A and 236B mounted within circular openings in respective secondary beams 224, pivotally connecting the secondary beams to flanges 226 near each end of the main beam. Rings 230 retain shafts 234 in place. Like main beam 214, the secondary beams are formed of a welded plate assembly that results in a variable height and a rectangular cross-section.

Four tertiary beams 238 are each pivotally mounted at the center of its longitudinal axis to one of respective secondary beams 224 substantially at a respective end of the secondary beam for rotation in the same vertical plane that the main and secondary beams are rotatable within. Referring to FIGS. 7S and 7U, tertiary beams 238 carry collars 240 in circular openings 240A. These collars are aligned with two respective sets of complementary discs 242A and 242B, one set of discs 242A, 242B being mounted in circular openings near each end of secondary beams 224. Shafts 244 extend through aligned openings in the respective disc-collar-disc assembly 242A, 240, and 242B to pivotally connect the centers of tertiary beams 238 to the respective ends of secondary beams 224 in a conventional manner. The end portions of the upper and lower faces of secondary beams 224 are cut open somewhat to permit unimpeded movement of tertiary beams 238.

Eight suspension rods 246 are each pivotally mounted at their upper ends to each of respective ends 238E of the tertiary beams for rotation in the vertical plane. Bolts 248 pass through circular openings in each of the suspension rod halves 246A, 246B as well as a circular opening in each of the ends of tertiary beams 238. cylindrical bearings 250 are positioned about bolt 248 to facilitate relative rotation between the suspension rods and the tertiary beams, and to maintain the spacing between the suspension rod halves. Similar bearings are provided at other interfaces where components rotate relative to one another throughout the lower saddle, in conventional fashion.

The other end of each suspension rod 246 is pivotally connected to a cross-tie 256 by way of flange 258 that extends upwardly from connecting plate 259. Cross-ties 256 function to transmit vertical and lateral vehicle loads to the vertical and lateral load transmission systems, via the engagement of the vehicle wheels with the rails carried by the cross-ties. Connecting plate 259 is bolted via four bolts 259A about the intersection of the cross-tie's longitudinal axis with the axis of an equalizing beam (described below), enabling rotation of cross-ties 256 in the vertical plane relative to the suspension rods. As shown in FIG. 7H, bolts 259A actually consist of four sets of bolts of varying lengths to accommodate the differing thicknesses of the equalizing beam across lower saddle 200.

Bolts 252 pass through circular openings at the bottom of suspension rod halves 246A, 246B and openings through flanges 258. The suspension rod halves are connected with welded web 257 that effectively provides an I-section to minimize the risk of instability in the suspension rods. Cylindrical bearings 254 again facilitate relative rotation and maintain the spacing between the suspension rod halves. Rod halves 246A, 246B are enlarged at each of their ends for the pivotal connections to the tertiary beams and the cross-ties, respectively, as shown in FIG. 7R. This rotation of the suspension rods at both ends prevents the rods from taking any moment due to lateral forces which, as explained below, are devoted to the equalizing beam.

In another preferred embodiment of the vertical load transmission means of the lower saddle, shown in FIGS. 7Y and 7Z, bracing rod pairs 247 and shock absorbers 249 are added to alternate tertiary beams 239 and suspension rods 246 to further dampen the impact of vertical loads applied to the track cable systems by dampening the rate at which the suspension rods and the tertiary beams rotate relative to one another. The figures disclose an embodiment wherein the secondary and tertiary beams have hanger plates being used to connect lower members to higher members. Secondary hanger plate 229 is shown suspended from alternate secondary beam 225 to support alternate tertiary beam 239. Tertiary hanger plates 241 are shown suspended from alternate tertiary beam 239 to support suspension rods 246. Additionally, sets of suspension rods 246 are used rather than single suspension rods 246 at each end of each tertiary beam.

Bracing rod pairs 247 have holes at either end through which bolts 253 pass, thereby pivotally connecting the bracing rods to the rest of the assembly. The end of shock absorber 249 adjacent to the lower end of the suspension rods is also pinned by bolt 253 to pivotally connect the shock absorber to the suspension rods 246, bracing rod pair 247, and alternate cross-ties 255. The alternate cross-ties are substantially similar to cross-ties 256 described below, but have two flanges 258 rather than one, as shown in FIG. 7T. The additional flange enables attachment of a shock absorber between the flanges, as seen in FIG. 7Z. The opposite end of the shock absorber, i.e. the upper end, is pivotally connected to the adjacent tertiary beam by pinning the shock absorber with bolt 251 through tertiary hanger plates 241 and suspension rods 246. Those skilled in the art will appreciate that bracing rod pairs 247 and shock absorbers 249 could be appended to the first disclosed beam and hanger arrangement.

Cross-ties 256 are different from cross-ties 25 on the pylon spans, which are described below. Cross-ties 256 transmit an upward vertical force to the track cable systems to support them at intermediate points between pylons. Cross-ties 25 transmit an upward vertical force to the track cable systems to support them from the lower saddle 200. Referring to FIG. 7X, cross-ties 256 include flat plates 257 to which grooved blocks 257A are welded to serve as a bearing for track cable systems 14. A rail is provided in the form of a second grooved block R that is used to clamp the carrier cables to cross-ties 256. Three rows of bolts are used to secure grooved blocks R to flat plate 257, as shown in FIG. 7W. Interim cable track support sections 257A' are provided between cross-ties 256 and are connected to grooved blocks 257A to form a continuous bearing cradle for track cable systems 14. Grooved blocks R are butterfly shaped, as viewed in FIG. 7I, resulting from symmetrical grooves cut into each end. Interim rail sections, not shown, having tongued ends for engaging the grooved ends of the blocks R and are connected thereto to form a continuous rail for supporting the vehicle wheels along the length of the lower saddle.

Lower saddle 200 further includes a lateral load transmission system that contains equalizing beam 260 carried across the cross-ties 256, and lateral support stud 282 carried by transverse connecting frame 204, as shown in FIGS. 7H and 7V. Thus, equalizing beam 260 spans transversely across the lower saddle's cross-ties 256 to transmit lateral forces to lateral support stud 282. The equalizing beam further serves to stabilize suspension rods 246 in the face of lateral forces. The equalizing beam must be flexible in the vertical direction so that the vertical load transmission system operates effectively as an isostatic system, but also must be reasonably stiff in the lateral direction to transmit lateral forces.

To meet these seemingly contradictory requirements, equalizing beam 260 includes superimposed plates 264, 266, 268, and 270 of different lengths and thicknesses, as displayed in FIGS. 7V and 7W. Thus, plate 264 is shorter than plate 266, which is shorter than plate 268, and so forth. Also, as particularly shown in FIG. 7W, the widths of the plates are greatest at the center of their longitudinal axes and decrease along the lengths of the plates towards each of their ends. This variable width, plus the variable thickness of the super-imposed plate stack, decreases the lateral and vertical moments of inertia of the equalizing beam at its end where bending strength is least needed.

Lateral and vertical loads are transmitted at cross-ties 256 by four bolts 259A that connect the cross-ties to both the vertical and lateral load transmission systems, which operate independently from one another. Thus, as explained above, cross-ties 256 are connected to suspension rods 246 and equalizing beam 260 using bolts 259A. Referring to FIGS. 7R and 7T, the bolts are fixed in threaded holes 259B in the cross-ties for better transmission of lateral forces than if secured with nuts.

The plates of equalizing beam 260 are joined together near their centers by bolting the plates together along with the center-most cross-ties 256 and suspension rods 246 using bolts 259A, as displayed in the left-most equalizing beam 256 of FIG. 7W. The plates of the equalizing beam should otherwise, i.e., outside of the center, be free to move longitudinally. This freedom of movement is realized by using a teflon coating between the plates that provides for maximum vertical flexibility, and by making the bolt holes in the plates that are aligned with the other cross-ties slotted in the longitudinal direction. Bolt sleeves 259B are provided in these slotted bolt holes that are slightly taller than the equalizing beam's plate stack to avoid clamping the plates outside of their centers, as shown in the lower portion of FIG. 7R. This allows vertical loads that are transmitted from cross-ties 256 to suspension rods 246 to effectively bypass equalizing beam 260.

Referring to FIG. 7N, the lateral load transmission system is further connected to transverse connecting frame 204 and extends downwardly therefrom in the form of lateral support stud 282 to provide for lateral rigidity of the track cable systems and to sustain loads due to environmental conditions. Lateral support housing 276 is connected to and extends downwardly beneath transverse support beam 208. Lateral support stud 282 is encased within housing 276 and extends downwardly through the center thereof.

The lower portion of steel lateral support stud 282 is tapered and extends downwardly through respective aligned grooves 286 formed through clamping plates 262 as well as each of the plates of the equalizing beam, as shown in FIGS. 7J and 7K. External contact faces of the stud are chromium plated, and are capped with plates 282A made of a hardened steel material, e.g., quenched and tempered steel. Clamping plates 262 are provided with guide blocks 284 for engaging lateral support stud plates 282A and limiting the motion of stud 282 within groove 286 to linear motion along the axis of the equalizing beam. Guide blocks 284 are also made of a hardened steel material in order to sustain the high contact pressure at the lateral support stud plates. A plurality of bolts 286A are positioned in aligned bores through the assembly of clamping plates 262, guide block 284, and equalizing beam 260 about grooves 286 and secured with nuts to clamp the assembly. In this manner, lateral movement of the cross-ties, as well as track cable systems 14 supported at each of the ends thereof, is controlled.

Thus, lateral loads resulting from environmental conditions and deviation (up to 7 degrees either direction) of the upper saddle are applied through cross-ties 256 and equalizing beam 260 to lateral support stud 282. The lateral forces are then transmitted through transverse connecting frame 204 or alternatively to base pylon beam 201, which carries the lateral support stud, to the base pylon.

In the alternate means of connecting a lower saddle to a base pylon beam 201 as describe above in association with FIGS. 7Y and 7Z, the support stud 282 is also employed. The support stud is fixed to a lower attachment plate 281. The lower attachment plate has holes to align with the holes in hanger plate 211, and by receiving bolts through those holes is removably affixed to the hanger plate and thus to pylon beam 201. As in the first described attachment of the lower saddle, housing 276 is used to provide lateral support to support stud 282.

Referring again to FIGS. 6 and 7B, upper saddle 30, which is pivotable on pins 60 and includes upright 32, constitutes a yieldable leg deviating from a strict vertical orientation in response to loads on catenary cable system 16 up to 7° either direction. When engaged with coupling 40 and joined by pin 44, cable connectors 42 can rotate relative to coupling 40. The relative rotation of cable connectors 42 and coupling 40 is a response to loads on upper saddle 30 received via catenary cable system 16, and permits deviation of the yieldable leg. As stated above, bottom saddle 200 is designed to accommodate this deviation and, through equalizing beam 260, to: (1) minimize in-plane rigidity; and (2) provide lateral rigidity to sustain environmental loads and forces of pylon 17's deviation from the strict vertical orientation. Through this yieldable leg and bottom saddle described above, the present invention contravenes the art by providing self-adjusting pylons 17, and provides for a smooth transit of vehicle 12 across the system in accordance with regulatory guidelines.

The present invention also contemplates two additional embodiments of the upper saddle and base pylon combination. FIG. 7AA shows one alternate embodiment. Therein, tubular upright 33 is supported by tubular base pylon 23 that has an opening in its upper end through which a lower end 35 of the upright extends. The arrangement permits rotation of upper saddle 31 about pivot point 23*a* in response to forces applied to the catenary cable system, but limits the rotation by interference of lower end 35 of upright 33 against the inside of tubular base pylon 23. Coupling 41 is substantially similar to coupling 40 disclosed above.

FIGS. 7AB–7AE illustrate a second alternate embodiment of the upper saddle and base pylon. As shown in FIG. 7AB, a base pylon 29 supports an upper saddle composed of a bearing assembly 135 and cable attachment assemblies 140. Bearing assembly 135 is composed of base plate 136 that provides holes for receiving bolts to connect to base pylon 29 below, and a platform for connection of additional components above. Support member 137 extends vertically from base plate 136 to provide vertical separation between the base plate and catenary cable system 16 supported above. Roller base 138 is supported on top of support member 137 to provide a surface that defines a pattern of travel of cable attachment assemblies 140 above. In the embodiment shown, the pattern of travel defined is a curvilinear pattern approximating the natural curve of catenary cable system 16 under a given load. FIG. 7AC shows two crane rails 139 supported on top of roller base 138 to provide wheel-bearing surfaces on which cable attachment assemblies 140 can travel.

The components of cable attachment assemblies 140 are illustrated in FIGS. 7AC–7AE. Each cable attachment assembly is supported on crane rails 139 by wheels 141 which are coaxially attached to axle 142. Axle 142 is attached to additional components used to clamp the catenary cable system by axle retainers 143. Axle retainers 143 are bolted to upper channel members 144. Upper channel members 144 are welded to a plate 146 and angles 147 to make up the upper one half of the components used to clamp the catenary cable system. Lower channel members 145 are similarly welded to a plate 146 and angles 147 to form the lower half of the components used to clamp the catenary cable system. The upper and lower halves are bolted together through angles 147 at their ends and through plates 146 near their centers. Teflon linings 148 are fitted around the catenary cable system 16 (cable 16*a* and 16*b*) between the two halves so that when the bolts connecting the two halves are tightened, adequate pressure will be exerted on the catenary cables to connect the cables to the cable clamping assemblies. However, the flexibility of the teflon will be relied upon to ensure that the applied pressure will not be so great as to crush or damage the cables.

Figure 8A:
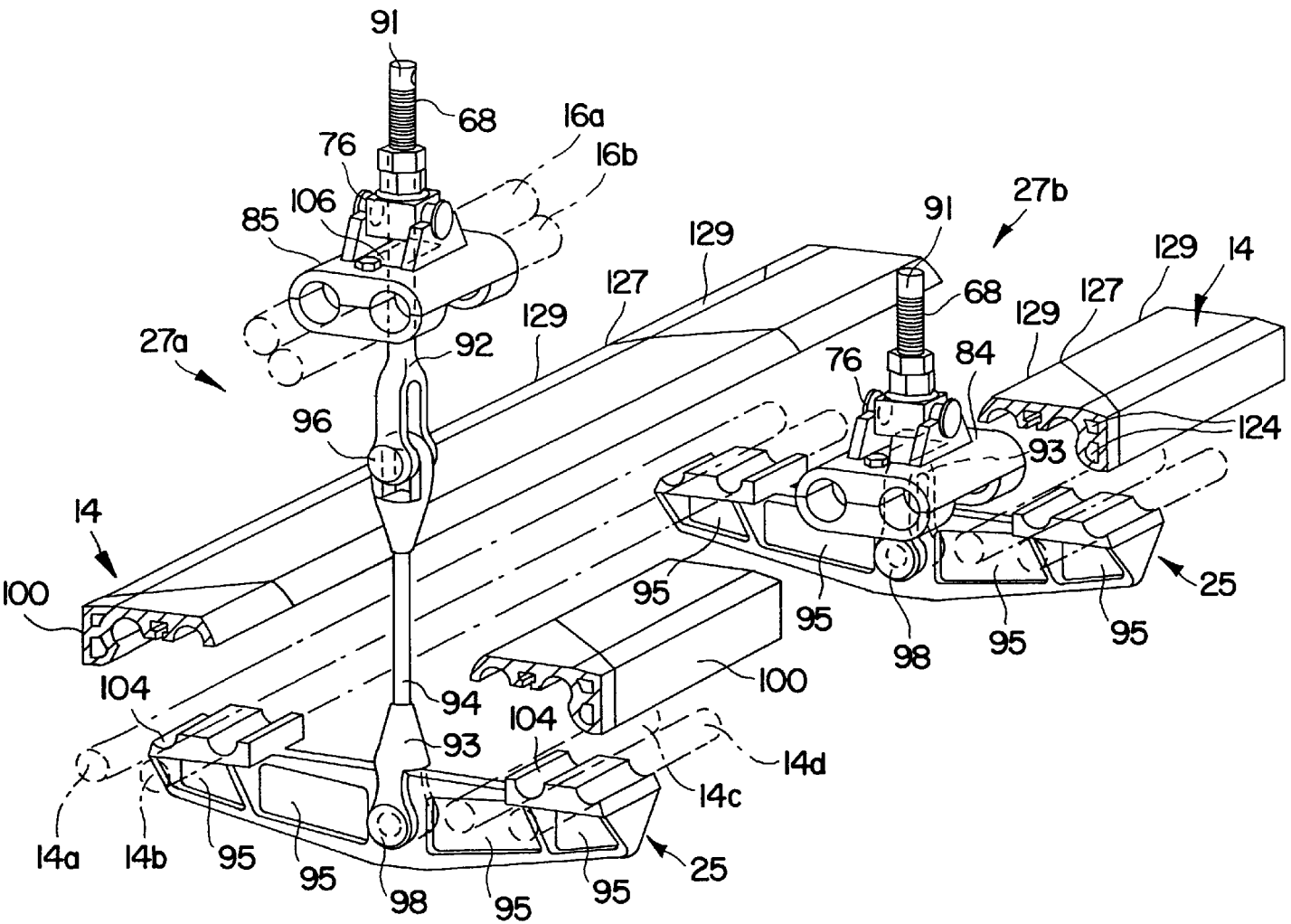
FIGS. 8A–B illustrate the hangers, cross-ties, and rails of the track cable systems in the new system in an isometric view.

The cables, rails, and cross-ties of the elevated cableway system are illustrated in FIGS. 8A–10C. FIG. 8A is an isometric, partially exploded view of hangers 27*a–b,* cross-ties 25, and carrier rail 14 of the present invention that replace the counterparts in the Müller '765 patent depicted in FIG. 2. FIG. 8B is a frontal, elevation view of long hanger 27*a* and cross-tie 25 and shows the relationship of vehicle 12 to one such hanger/cross-tie combination in ghosted lines.

Figure 8B:
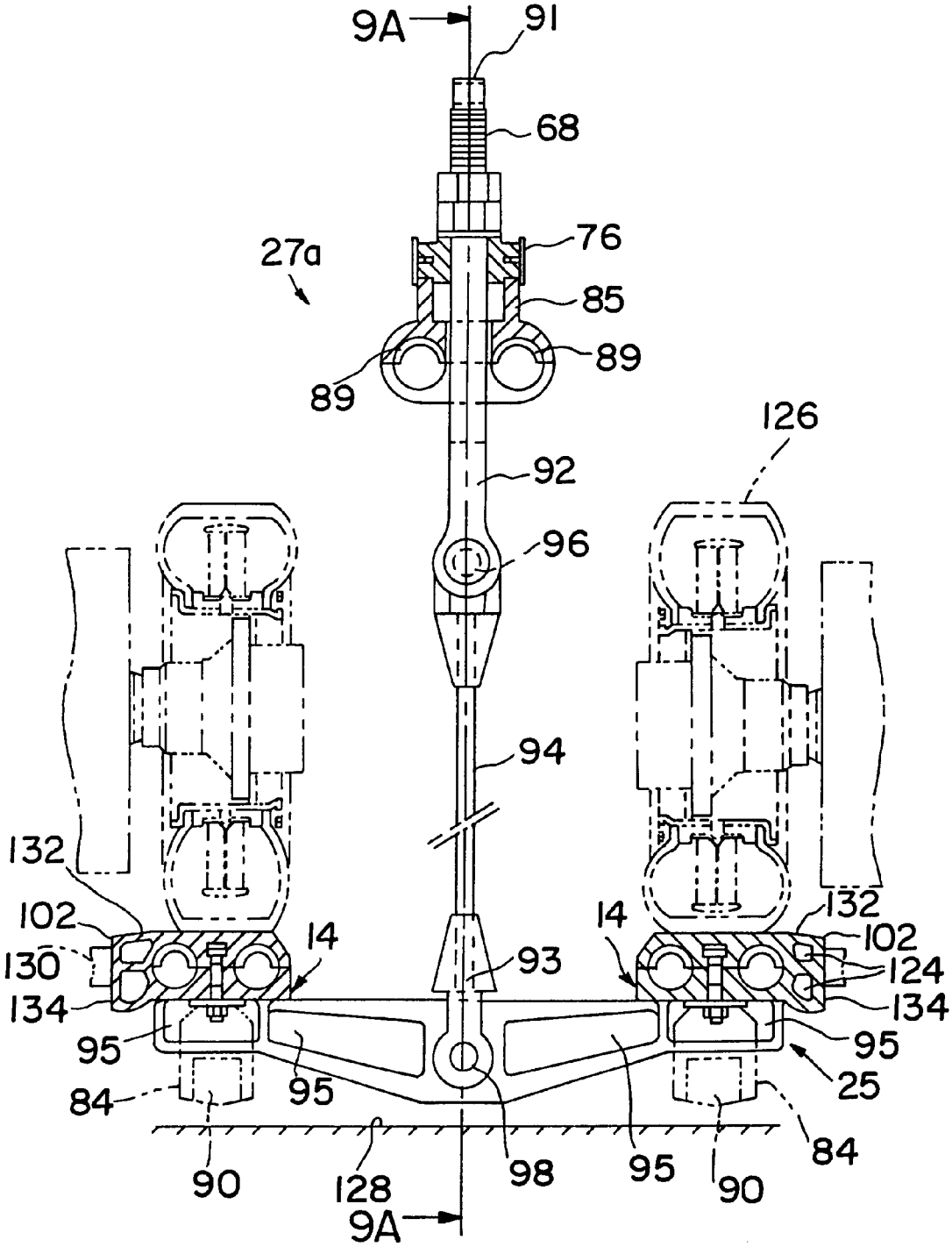
Figure 9A:
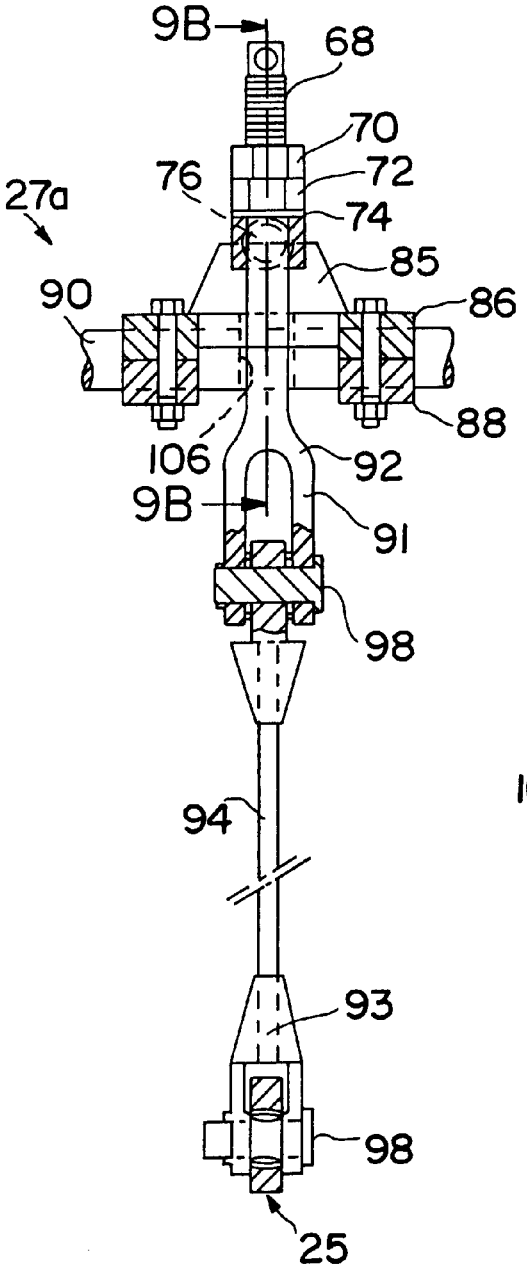
FIGS. 9A–B illustrate the hangers, cross-ties, and power rail of the new system in section along line 9A—9A of FIG. 8B and in partial cutaway.
Figure 9B:
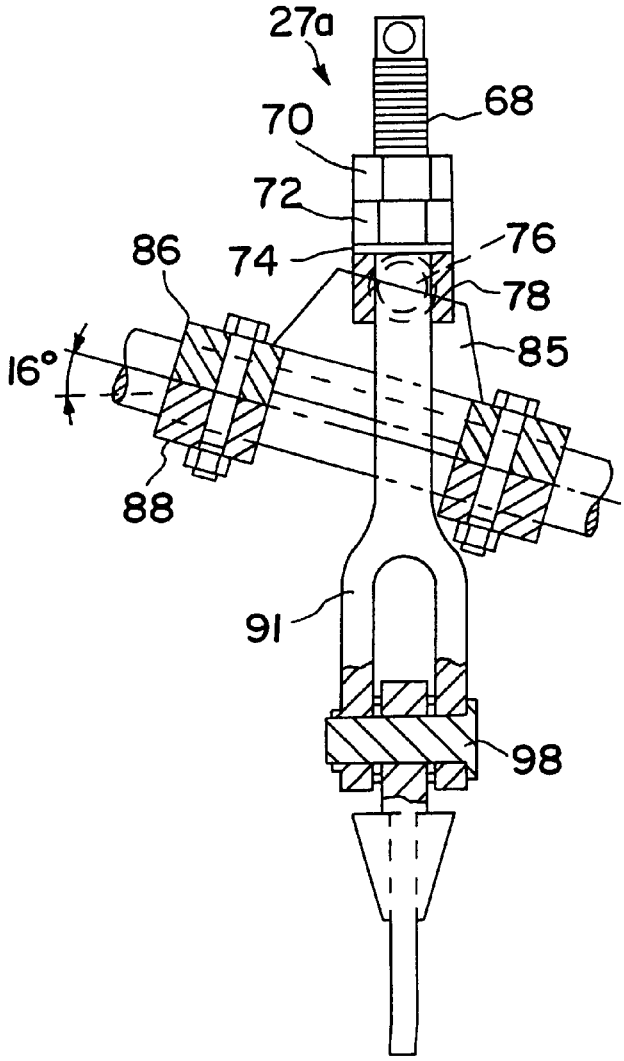

FIGS. 9A and 9B provide additional views of hanger 27*a:* FIG. 9A in section and partial cutaway along line 9A—9A of FIG. 8B; and FIG. 9B in section along line 9B—9B of FIG. 9A. FIGS. 10A–C depict rail 100, cables 14*c–d,* and cross-tie 25. FIG. 10A is a partial top view, FIG. 10B is a section taken along line 10B—10B of FIG. 10A in partial cutaway, and FIG. 10C in a front view of rail 100 and bottom guide 102.

Figures 1, 2, 3:
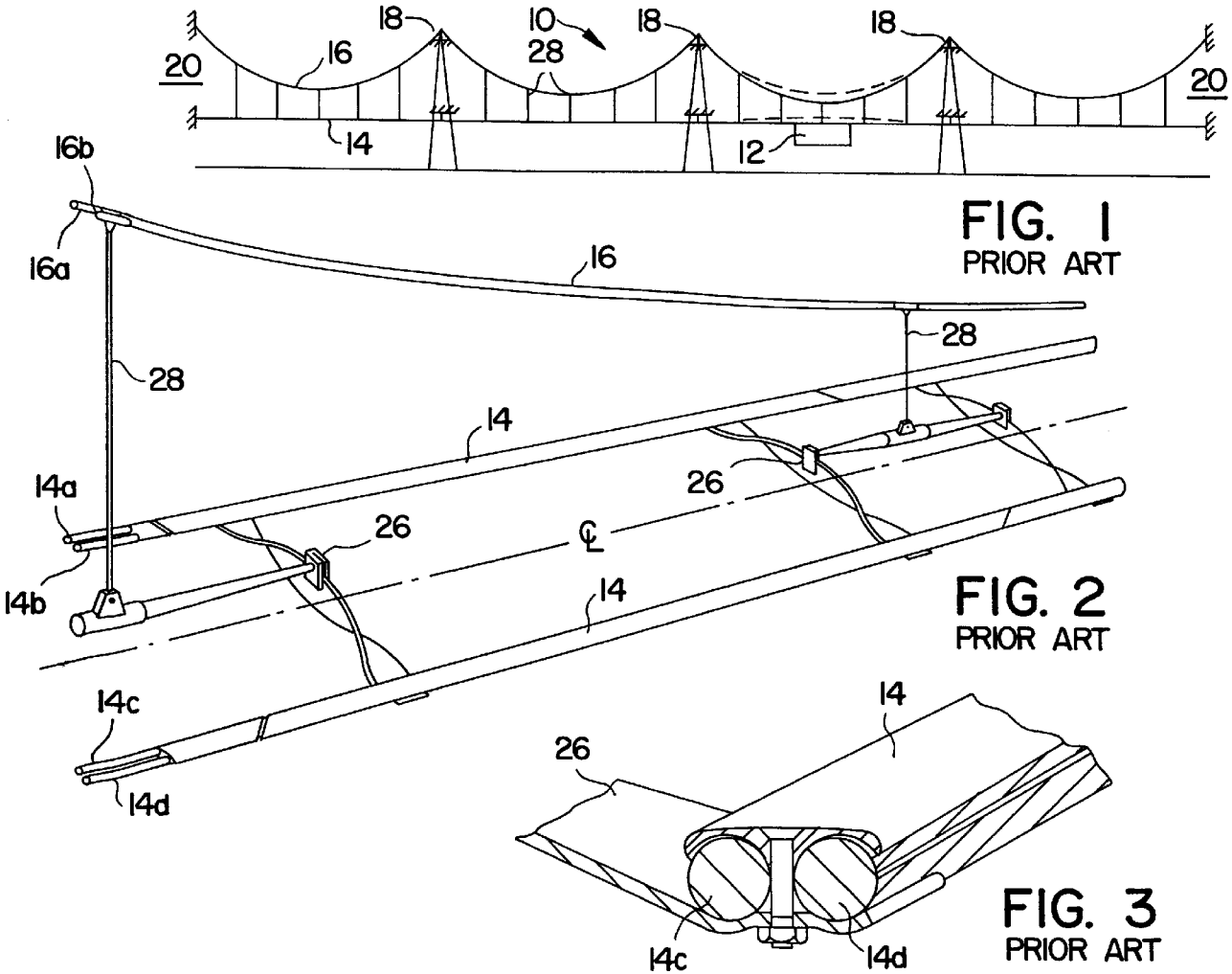
FIG. 1 PRIOR ART
FIG. 2 PRIOR ART
FIG. 3 PRIOR ART
FIGS. 1–5 illustrate a prior art cableway system disclosed and claimed in U.S. Pat. No. 4,069,765 issued Jan. 24, 1978 to Gerhard Müller and correspond to FIGS. 3–7 therein.
Figure 4:
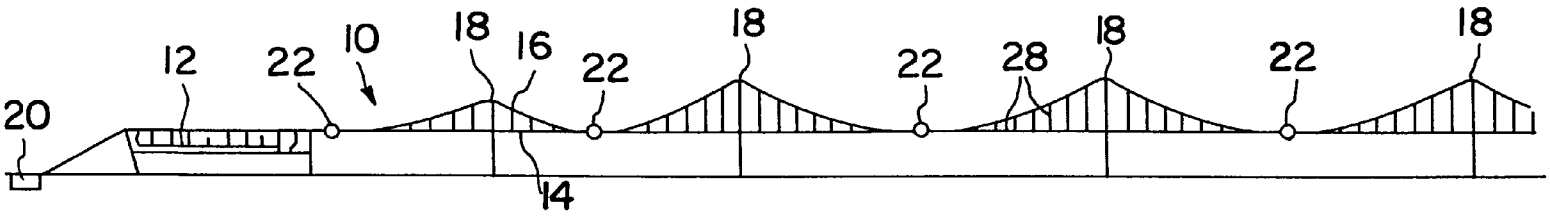
FIG. 4 PRIOR ART
Figure 5:
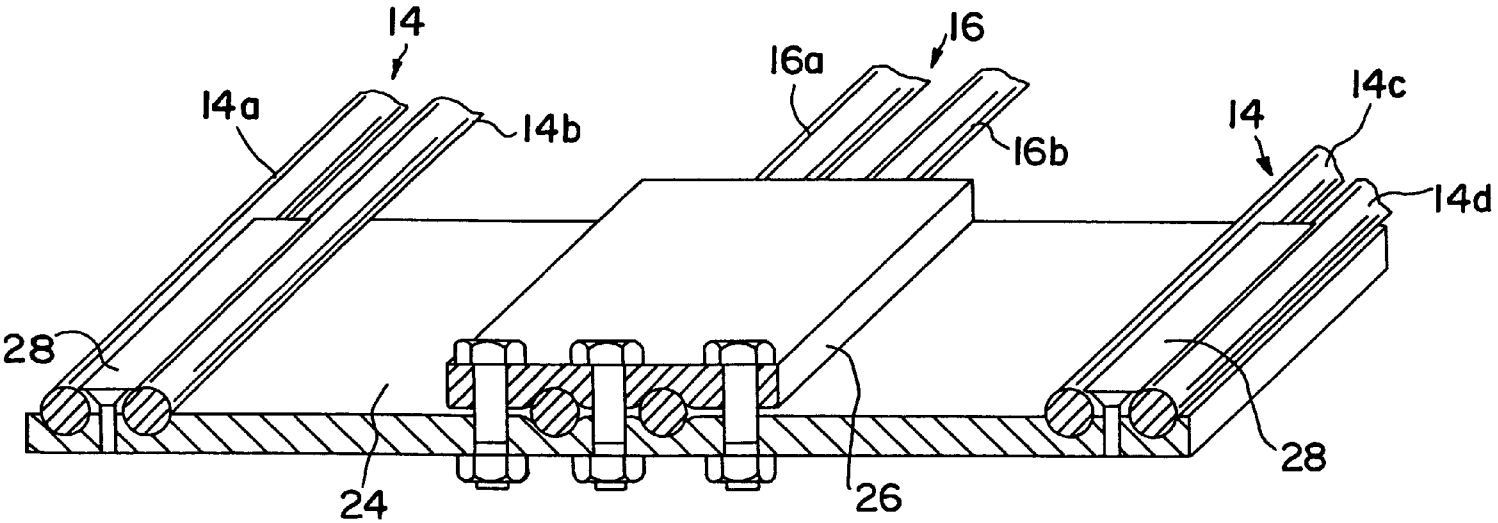
FIG. 5 PRIOR ART

Returning to FIG. 8A, two alternative embodiments for hanger 27 are shown: long hanger 27*a* and short hanger 27*b.* As is shown in FIGS. 2 and 4, both long and short hangers are used depending on the hanger's distance from pylon 17 and span midpoint 22. In addition to differing lengths, hangers 27*a–b* differ in that hanger member 91 of hanger 27*a* is a locked-coil steel cable but in hanger 27*b* is a rod. Furthermore, short hanger 27*b* can be used in different lengths using the same construction. Two different lengths are used for short hanger 27*b* in a single 600 m span in the preferred embodiment.

The length of hangers 27*a–b* is calculated to pre-tension track cable systems 14 as described above, to transmit vertical, pre-tensioning forces to pylon 17, and to ensure clearance between catenary cable clamp 85 and vehicle 12 in high winds, and so the length thereof will depend on the particular application for a given embodiment. The effective length of hangers 27*a–b* can be adjusted by tightening and loosening nuts 70 and 72 on threaded end 68 of hanger member 91 described below to adjust the pre-tensioning forces. The length of the threads on threaded end 68 must consequently be sufficient to accommodate the desirable range of tensions. In long hanger 27*a,* this will nominally be a 0–300 mm and in short hanger 27B the length will vary but be at least greater than 50 mm.

Hangers 27*a–b* are suspended from catenary cable system 16 by clamping cables 16*a–b* in openings 87*a–b* of suspension clamp 85 shown in FIG. 8A. Suspension clamp 85 is pivotably mounted to hanger member 91 at pivot 76. Suspension clamp 85 comprises first guide member 86 bolted to lower guide member 88 as shown in FIGS. 9A–B. Suspension clamp 85 includes passage 106 through which threaded end 68 of hanger member 91 extends, and block 78 joined to first guide member 86 at pivot 76 such that catenary cable system 16 and suspension clamp 85 may pivot relative to hanger member 91 16° relative to the horizontal normal as shown in FIG. 9D. Block 78 includes a bore through which threaded end 68 of hanger member 91 extends. Block 78 rests on a shoulder formed on threaded end 68 and is secured thereagainst by nuts 70 and 72 and washer 74.

Disadvantages to the clamping of cable 16 typically include cable fatigue and the "beam effect", in which cable behaves structurally as a beam. Suspension clamp 85 minimizes these disadvantages by including flared openings 89 in grooves 87*a–b* as shown in FIGS. 9A–9B. Flared openings are also employed in equalizing locks 300 discussed below and shown in FIGS. 11A–D.

Hanger member 91, as shown in FIGS. 8A–B, of long hanger 27*a* is jointed and includes upper piece 92, essentially a threaded fork member, and lower piece 94, a steel cable, moving relative to one another at joint 96; hanger member 91 of short hanger 27*b* is not jointed. The articulation provided by joint 96 and pivot 76 provides flexibility in hanger 27*a* that will reduce bending moments therein resulting from the loads of power rail 90 and vehicle 12, as well as other forces. Hence, the elimination of joint 96 in hanger 27*b,* in which bending moments are of less concern because of the shorter length of hanger member 91, and the inclusion of pivot 76, permit the suspending of hanger 27*b* from catenary cable system 16.

Referring still to FIGS. 8A–B, cross-tie 25 is an asymmetric I-beam mounted to the hanger member 91 at pivot 98 at collar 93 of hanger member 91 distal to catenary cable system 16 in both long hanger 27*a* and short hanger 27*b.* Pivot 98 is a cylindrical plain bearing providing flexibility and thereby reducing flexural effects in cables 14 and 16. Cross-tie 25 is preferably constructed from cast steel and is I-shaped in cross-section as shown in the isometric view of FIG. 8A and in the cross-sectional view of FIG. 10B. Openings 95 are either cast or milled in cross-tie 25 to reduce weight and, consequently, the load on catenary cable system 16.

Cables 14*a–d* of track cable systems 14 are shown in ghosted lines in FIG. 8A. Track cable guides 102 comprising bottom guide members 104 and rails 100, joined as shown more fully in FIGS. 10A–C, are mounted to opposite ends of cross-tie 25 as shown in FIGS. 8A–B. Guide members 104 may be either formed integrally with or bolted to cross-tie 25 as best shown in FIGS. 10B and 10C by bolts 114 extending through bores 116 and secured by nut and washer combinations 118. Still referring to FIGS. 10A–C, rails 100 are then mounted by mating bolts 114 with slot 120 in rail 100 and sliding rails 100 until properly positioned as shown in FIG. 10C. When rails 100 are properly positioned relative to guides 104, rails 100 and guides 104 define grooves 122 shown in FIG. 10C through which cables 14*a–d* are strung as shown best in FIGS. 10A–B and in ghosted lines in FIG. 8A.

Rails 100 constructed of aluminum comprise modular segments that typically are sufficiently large to span the entire distance between hangers 27. Although one end of each segment will be relatively fixed in position by the mating of bolts 114 to slot 120 as discussed above, the other end will be softly, rather than rigidly, fixed by the mating of grooves 122 with cables 14*a–d*. The movement thereby permitted accommodates thermal expansion of the segments and is therefor desirable. Thus, thermal expansion joints 127 are created between rail segments such as joint 127 between segments 129 shown in FIGS. 8A, and 10A–B. Joints 127 are preferably angled at 45° relative to the longitudinal axis of rails 100. Rails 100 also include upper surfaces 132 and sides 134 providing a smooth and gliding surface for vehicle 12 in the preferred embodiment as discussed below. Although not shown, the preferred embodiment includes a layer of insulation between rails 100 and cables 14*a–d* to avoid corrosion and reduce noise.

Other modifications may be employed in the design of rails 100. For instance, holes 124 are milled into individual segments of rails 100 to decrease weight and the heads of bolts 114 need not be of uniform height above cross-tie 25 if it is desirable to incline segments of rails 100. One may furthermore provide some means for heating rails 100 for use in particularly cold climates. These and other such modifications are contemplated by and are within the scope of the invention.

As is known to those in the art, vehicle 12 must be powered as it traverses the system and so provision must be made for power rail 90 as shown in FIGS. 8B and 10B. Power rail 90 may be mounted to cross-tie 25 as shown in ghosted lines in FIGS. 8B and 10B. Power rail 90 is grasped by power rail guide 84 bolted to plate 112, which in turn is bolted to the bottom of cross-tie 25. As shown in FIG. 8B, a power rail 90 and power rail guide 84 are preferably mounted to each end of cross-tie 25 in this embodiment. Also as is known in the art, power rail 90 must be electrically insulated from all other parts of the system for safety reasons.

The relation of vehicle 12 to the combination of hanger 27, cross-tie 25, and track cable systems 14 is best illustrated in FIG. 8B. Carrier wheels 126 mounted on either side of the vehicle above its roof 128 in any convenient manner rotate in the vertical plane, ride on the upper surface 132 of rails 100, and carry the weight of vehicle 12. Guide wheels 130 rotate in the horizontal plane, contact sides 134 of rails 100, and maintain the lateral position of vehicle 12 vis-a-vis the carrier rails.

Figure 11B:
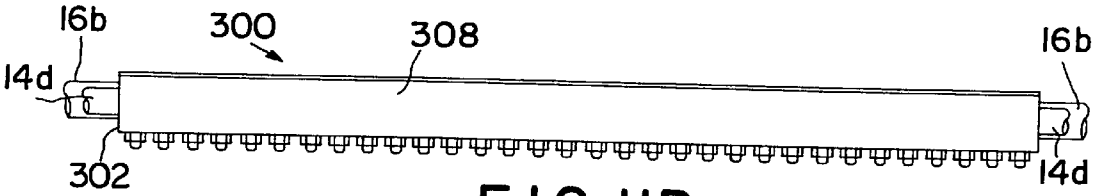
FIGS. 11A–D illustrate a force equalizing assembly tying the catenary and track cable systems at intermediate points in the span.
Figure 11A:
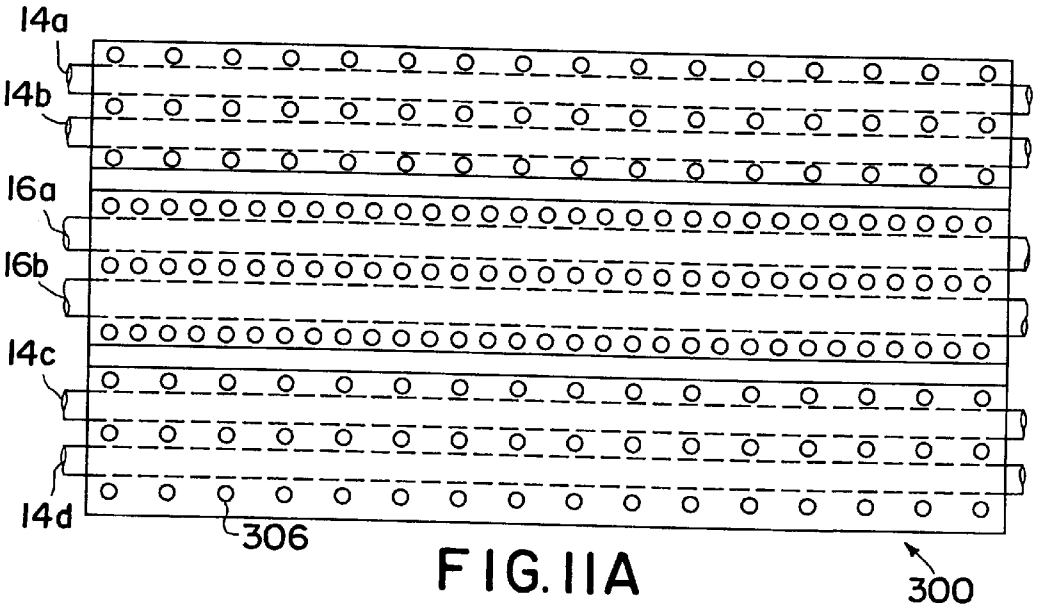
Figure 11D:
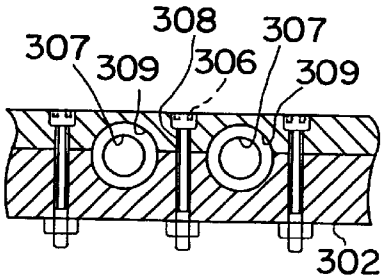
Figure 11C:
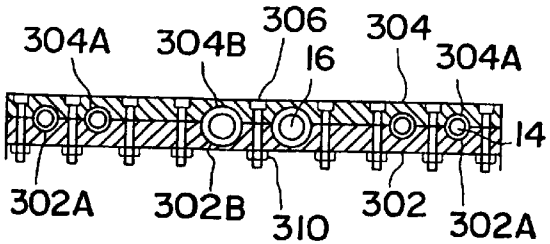

Referring now to FIGS. 11A–D, force equalizing assembly 300, also known as an equalizing lock, is provided for joining catenary cable system 16 to track cable systems 14 between the pylons to equalize the tension between the catenary and track cable systems. Force equalizing assembly 300 substantially prevents relative movement between catenary cable system 16 and track cable systems 14 and distributes forces therebetween through friction on the cables. As such, the force equalizing assembly reduces the maximum deflection of the guideway by impeding relative movement between the cables. Force equalizing assembly 300 includes force equalization plate 302 having three sets of parallel channels formed along the length of the upper surface thereof for accepting catenary cable system 16 in the center two channels 302B and track cable systems 14 in the outer four channels 302A. Thus, the channels are shaped to approximate one-half of the respective cable circumferences except that the ends of the channels are flared outwardly, as illustrated in FIGS. 11C and 11D.

Clamping plate 304 also has three sets of parallel channels that are formed along the length of the lower surface thereof for accepting catenary cable system 16 in center channels 304B and track cable systems 14 in outer channels 304A. Like the channels of the force equalization plates, the channels of the clamping plates are shaped to approximate one-half of the respective cable circumferences except that the ends of the channels are flared outwardly.

As shown in FIGS. 11C and 11D, the channeled surfaces of respective force equalization plates 302 and the clamping plates 304 are complementary such that the plates may be assembled about the cables for frictionally locking the cables within the respective channels to equalize the tension in the catenary and track cable systems. The respective flared ends of the channels in the assembled plates form a frusto-conical cavity in each end of the assembly about each of the cables for reducing wear on the cables by limiting engagement, and therefore bending stresses, with the ends of the plates, a feature lacking in the Müller disclosure. The flared ends are defined by narrower diameter 307 and greater diameter 309 in the opening of the channel through the assembly as best shown in FIG. 11D.

Plates 302, 304 are assembled by the insertion of a plurality of bolts 306 through a respective plurality of complementary bores 308 formed in the plates along the sides of the channels. Bolts 306 are high strength bolts to assure the proper tightening force, and are countersunk such that their heads are flush with the upper surface of clamping plates 304. Bolts 306 are retained by respective nuts 310. Flush mounting of the bolts prevents the possibility of the vehicle wheels colliding with one of them.

Clamping plate 304 may have an upper surface that is elevated at its center (not shown) above the two center channels 304B to provide a greater cross-sectional area at the areas of greatest stress. The upper surfaces of plate 304 are further adapted for engagement by the wheels of the cable car.

The force equalizing assembly interfaces with the rail profile to assure a continuous running track. The rail profile must therefore accommodate the profile, i.e., shape of equalizing lock 300. It follows that the 45° expansion gap in the rail cannot be used at the rail's engagement with the force equalizing assembly.

The present invention further contemplates two alternate embodiments of the force equalizing assembly of cable encasing members for connecting and distributing forces between the catenary cable system and the track cable systems. The first alternate force equalizing assembly, or equalizing lock is illustrated in FIG. 11E. Several wheel support rails, 350 and 354, have been removed in the figure in order to clearly illustrate the components below the rails. The assembly of cable encasing members is made up of frame 333 with connections thereto. The connections of the cables are made with spelter sockets 334, as shown in the figure, or by any other cable encasing connection known to those in the art. Frame 333 is made up of base frame 336 which is an elongated plate with U-shaped ends 338. U-shaped ends 338 of the embodiment shown consist of legs 340 and 342 which are of different lengths. Because legs 340 and 342 are of different lengths, clearance is created between the connections to allow for less moment stress development at the base of the "U" for a given tensile load on the cables. That is, if the legs were not of different lengths, the connections would be side by side. In order for the side by side connections not to interfere with one another, legs 340 and 342 would have to be farther apart. Because the legs would be farther apart, a greater moment would be created near their respective connections to the rest of the frame. The different length legs avoid this condition.

A plurality of askew connection plates 344 extend from the vertical faces of base frame 336 at acute angles to the longitudinal axis of the base frame and provide points of connection for track cable systems 14. On both sides of base frame 336, cross members 346 extend from the face of base frame 336 to carry spacer plates 348 and wheel support rails 350. Bracing bars 352 extend perpendicularly from cross members 346 to provide lateral support for the cross members.

Wheel support rails 350 span between cross members 346 and may have spacer plates 348 between the rails and the cross members to give additional elevation to the rails. Wheel support rails 350 typically do not have track cables running underneath them. However, wheel support rails near the transition points where the track cables must pass underneath and into the support rails must be altered to avoid interfering with the track cables. Thus, transition wheel support rails 354 have channels cut in their lower faces and sides to allow passage of the cable of the track cable systems 14 through the sides of the wheel support rails.

Figure 11F:
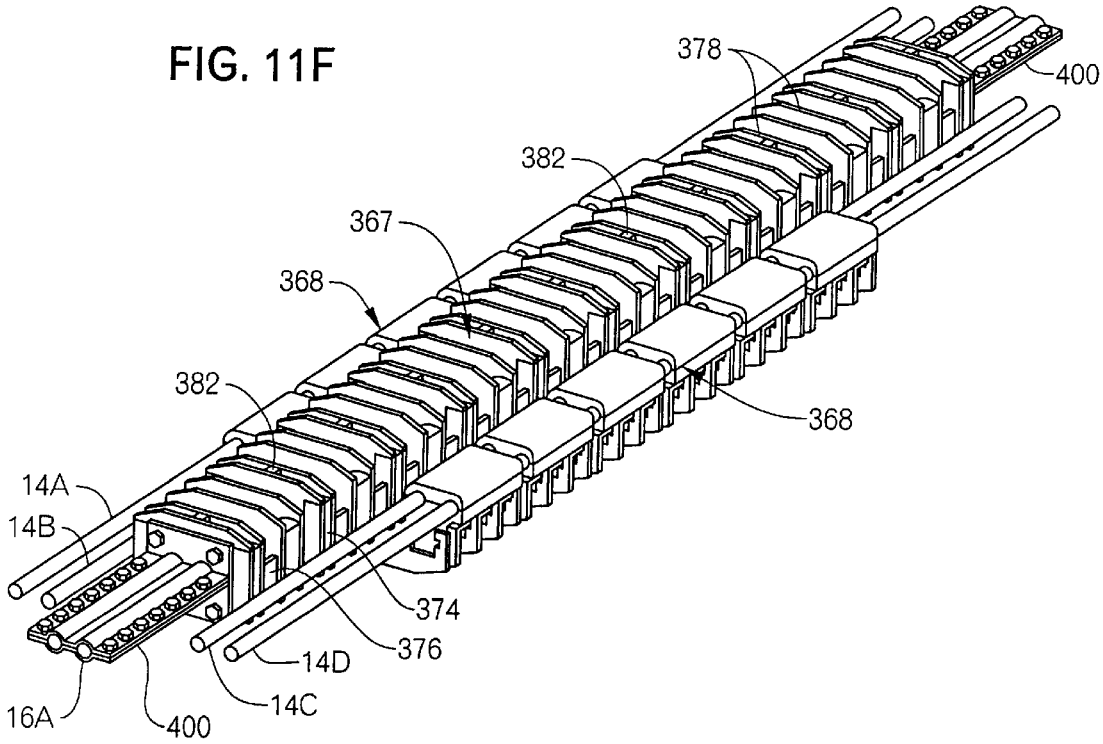
FIGS. 11F–11L show a second alternate force equalizing assembly.
Figure 11G:
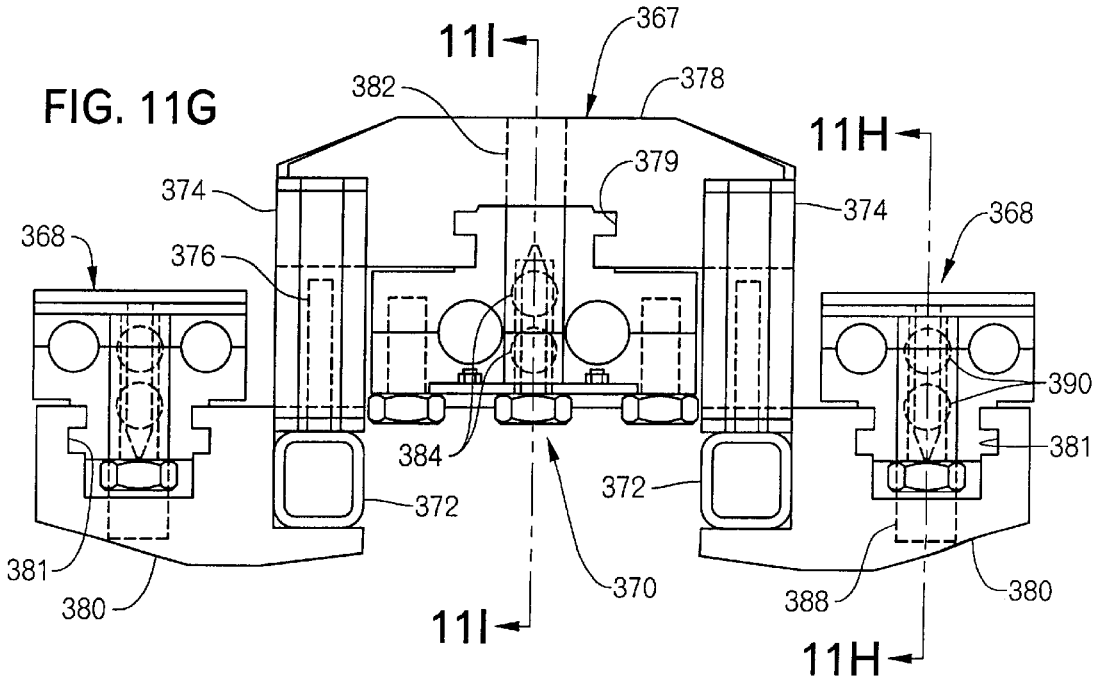

The second alternate force equalizing assembly is illustrated in FIGS. 11F–L. As illustrated in FIGS. 11F and 11G, the assembly of cable encasing members is made up of an assembly body 367, a catenary cable system clamp 370, and a pair of track cable system clamps 368.

In a preferred embodiment, assembly body 367 includes of a pair of parallel tubular beams 372 extending the length of the force equalizing assembly that support a plurality of cross extensions that in turn support catenary cable system clamp 370 and track cable system clamps 368.

Figure 11H:
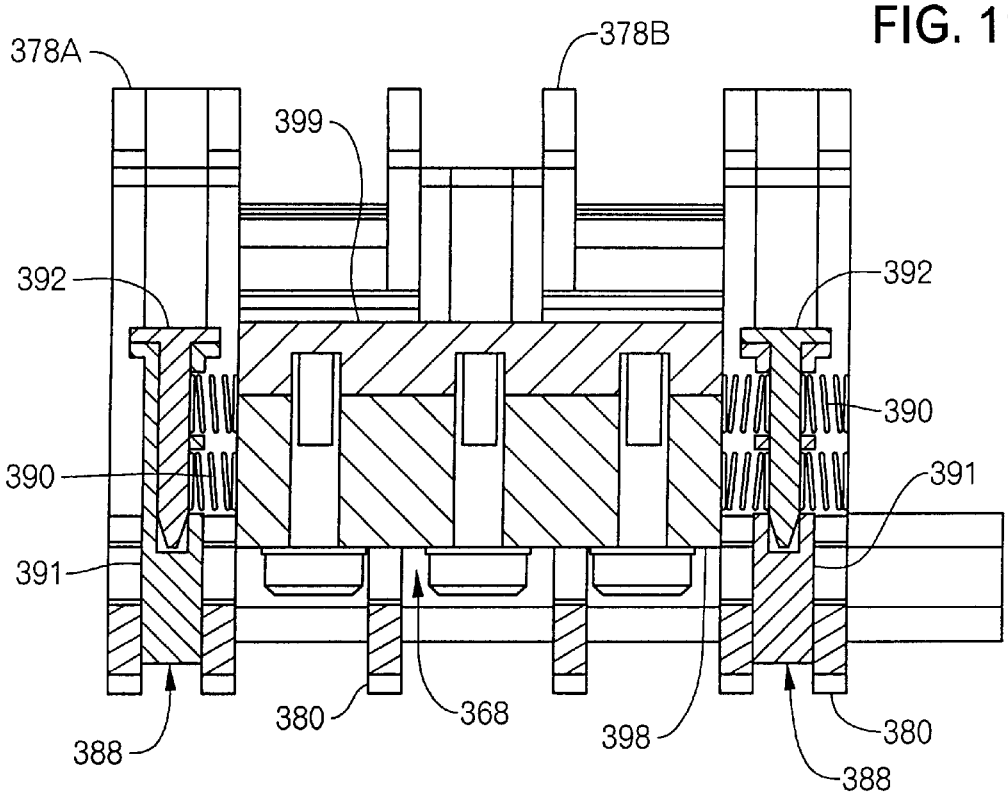
Figure 11I:
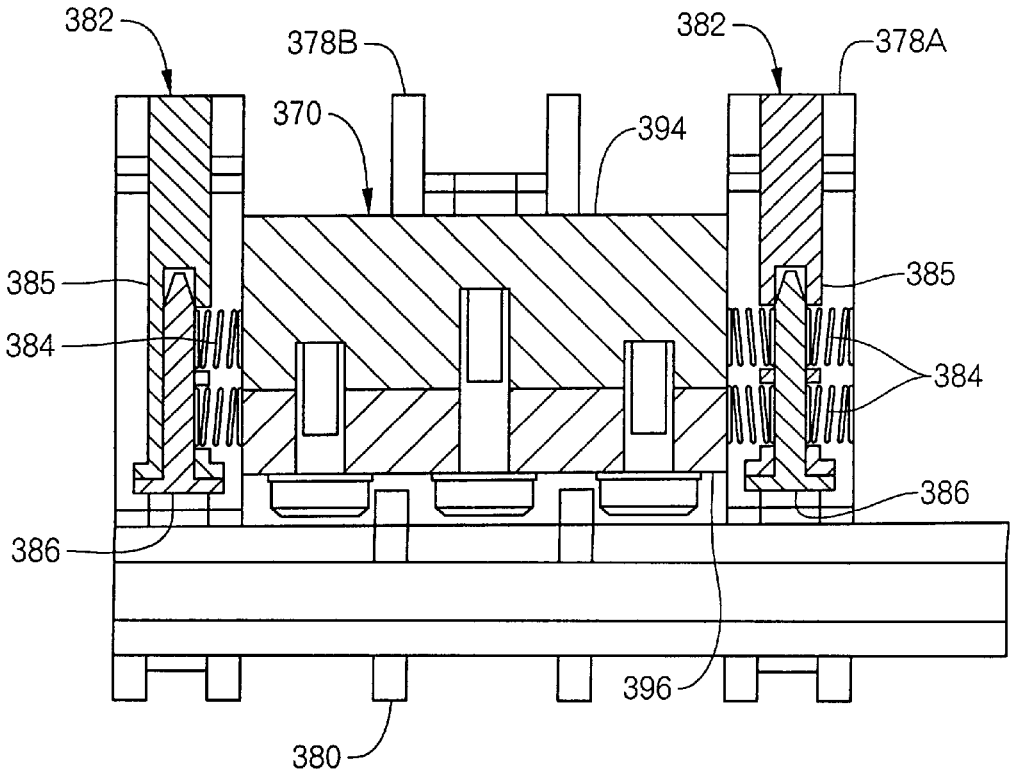

The cross extensions are made up of tubular columns 374, lateral bracing plates 376, span plates 378*a–b,* and wing plates 380, as shown in FIGS. 11G and 11I. A plurality of tubular columns 374 extend vertically from tubular beams 372 to support span plates 378*a–b.* Lateral bracing plates 376 are provided between consecutive tubular columns 374 to provide support to the columns. Span plates 378*a–b* are connected between laterally adjacent tubular columns 374 to support catenary cable system clamp 370. Span plates 378*a* are notched to sit on top of tubular columns 374. Span plates 378*b* are not notched and are attached to the sides of every other laterally adjacent set of tubular columns 374. Span plates 378*a* are attached to the tubular columns 374 at either end of the force equalizing assembly. Pairs of span plates 378*b* are therebetween attached to every other laterally adjacent set of tubular columns 374. Pairs of span plates 378*a* are attached to every other laterally adjacent set of tubular columns not connected by span plates 378*b.* Catenary cable system clamp 370 slides in catenary clamp grooves 379 between catenary cable reaction plates 382. Catenary cable reaction plates 382 are attached between alternating pairs of adjacent span plates 378*a.* Therefore, each catenary cable system clamp 370 slides in grooves 379 between every other pair of span plates 378*a.* Catenary cable springs 384 are placed between catenary cable system clamp 370 and reaction plates 382 to yieldably transfer forces between catenary cable system clamp 370 and reaction plates 382.

Figure 11J:
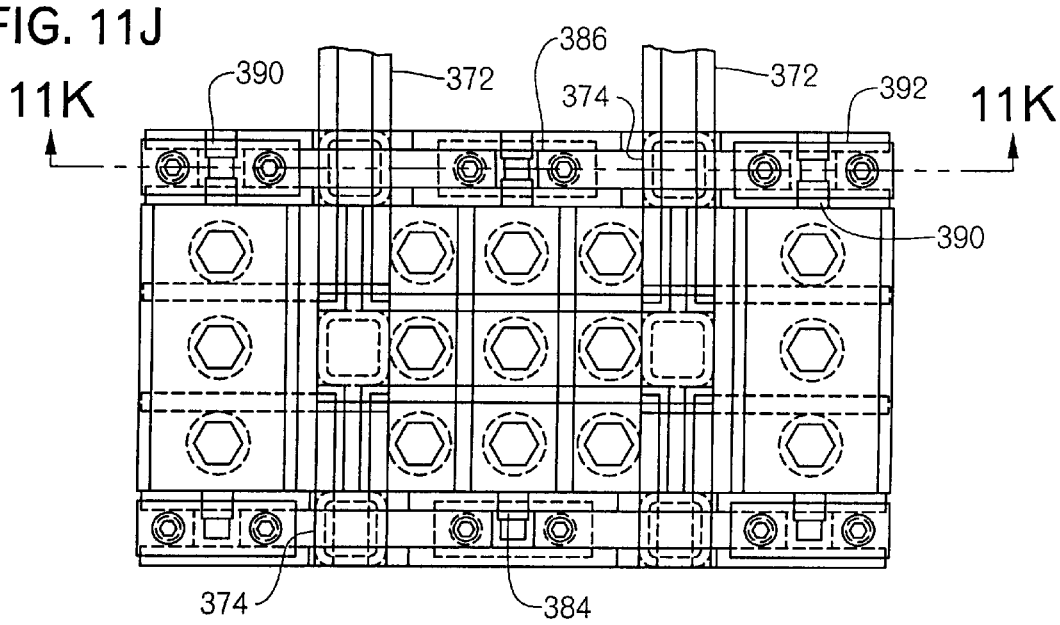
Figure 11K:
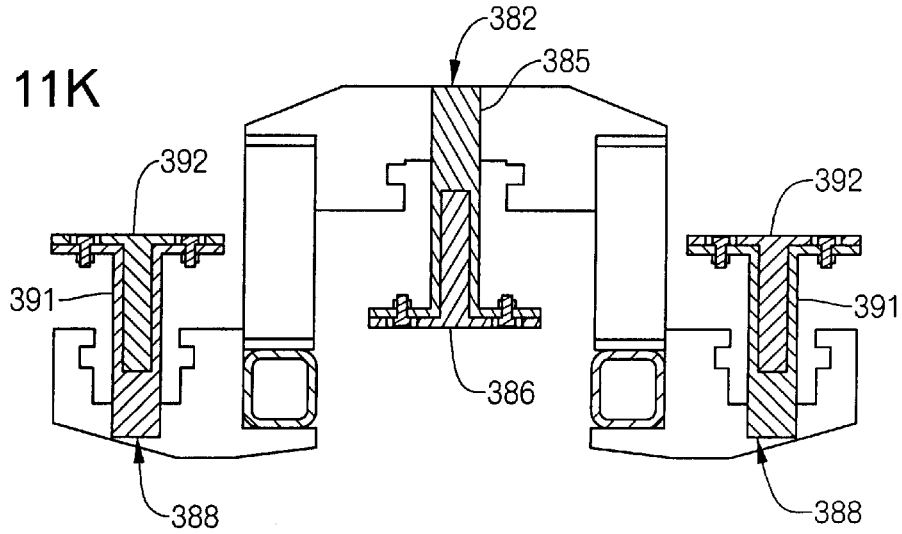

As illustrated in FIGS. 11J and 11K, catenary cable reaction plate 382 is made up of inverted T-shaped body 385 and insertable inverted T-shaped wedge 386, each connected to the other by bolts through both of their respective wings. Inverted T-shaped wedge 386 is used to facilitate assembly of the force equalizing assembly. After all of catenary cable system clamps 370 have been put in place about catenary cable system 16 and within assembly body 367, inverted T-shaped wedges 386 are inserted into inverted T-shaped bodies 385 and bolted in place. The function of the wedges is to energize catenary cable springs 384. Those skilled in the art will appreciate that it would not be possible to assemble and adjust catenary cable system clamps 370 about cables 16 if the springs were energized or compressed to workable loads during the assembly process. Therefore, by inserting wedges 386 between catenary cable springs 384 after all of catenary cable system clamps 370 have been put in place in assembly body 367, the force equalizing assembly can be successfully assembled.

Continuing now with the description of assembly body 367, wing plates 380 are attached to tubular beams 372 on both sides of the force equalizing assembly to provide support for track cable system clamps 368. Track cable system clamps 368 slides in track cable clamp grooves 381 between track cable reaction plates 388. Track cable reaction plates 388 are attached between alternating pairs of wing plates 380, as seen in FIG. 11H. Therefore, each track cable system clamp 368 slides in grooves 381 between every other pair of wing plates 380. Track cable springs 390 are placed between track cable system clamps 368 and reaction plates 388 to yieldably transfer forces between track cable system clamp 368 and reaction plates 388.

As illustrated in FIGS. 11J and 11K, track cable reaction plate 388 is made up of a T-shaped body 391 and an insertable T-shaped wedge 392, each connected to the other by bolts through both of their respective wings. In a manner essentially identical to inverted T-shaped wedge 386 of the catenary cable clamp described above, T-shaped wedge 392 of the track cable clamp is used to facilitate assembly of the force equalizing assembly.

As illustrated in FIGS. 11G and 11I, each catenary cable system clamp 370 is formed by a clamp sliding body 394 and a catenary clamping plate 396. Clamp sliding body 394 and clamping plate 396 have complementary channels in which cables of catenary cable system 16 are secured by bolting body 394 and plate 396 together. FIG. 11I also shows a cross-section of catenary reaction plate 382 as formed by inverted T-shaped wedge 386 inserted into inverted T-shaped body 385. Energized catenary cable springs 384 between wedge 386 and catenary cable system clamp 370 are also illustrated.

Similarly, as illustrated in FIGS. 11G and 11H, track cable system clamps 368 are formed by a clamp sliding body 398 and a clamping plate 399. Clamp sliding body 398 and a track clamping plate 399 have complementary channels in which cables of track cable systems 14 are secured by bolting body 398 and plate 399 together. Similar to FIG. 11I above, FIG. 11H shows arrangements of track reaction plates 388 and track springs 390.

With a large cable clamping mechanism such as the force equalizing assembly of the present embodiment, it is problematic that unless the cable slips near the end of a clamp closest to the application of load, the clamping pressure near the farthest end of a clamp cannot be fully utilized. That is, if the clamping pressure near the end of a clamp closest to an applied force is great enough to hold a cable without slipping, the clamping pressure at the end of the clamp farthest from the applied force is not utilized. In the preferred embodiment described here, this limitation is overcome by using a plurality of clamps that intermittently grasp the cables, but are allowed to deflect relative to one another and a fixed body, specifically assembly body 367. The means for accomplishing controlled relative movement among clamps is to place springs between the clamps and the cross extensions of the assembly body. By using springs with different spring constants, different amounts of resistance can be generated between selected clamps. By placing springs with lower spring constants closest to the end of the cable to which load is applied, these clamps will be allowed to deflect more under a given load. Since the clamps on the closest end are allowed to deflect more, more load is passed on to the farther clamps. By this mechanism the clamping pressures required by the respective clamps are equalized.

The arrangement described above is employed both with catenary cable springs 384 and catenary cable system clamps 370, and with track cable springs 390 and track cable system clamps 368. The numbers and spring constants of the various springs would be a matter left to the discretion of the designer for a given set of loadings.

Figure 11L:
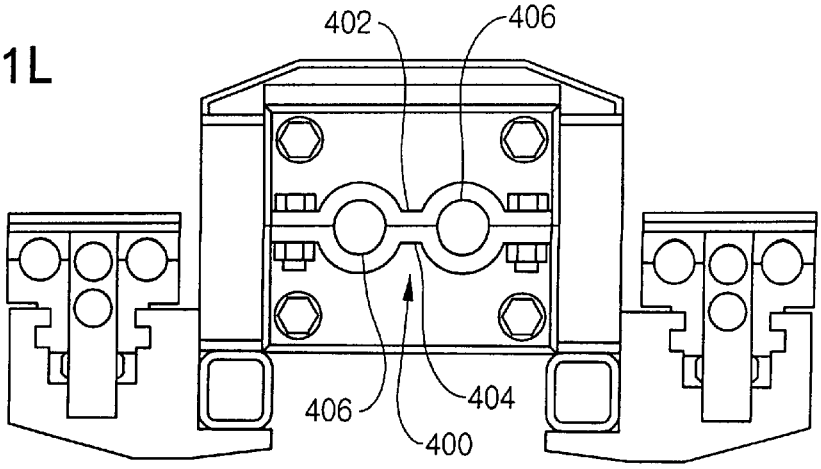

A basic problem with clamping cables is that large stresses tend to be generated near the point where a cable exits a clamp. Furthermore, the stress is accentuated if the cable is subjected to lateral loadings that additionally strain the cable at the exit point due to bending induced by the lateral loading. In a preferred embodiment of the present invention, as illustrated in FIGS. 11F and 11L, an extension member guide 400 is added to the force equalizing assembly to address this problem.

Extension member guide 400 is bolted to assembly body 367 at the entry and exit ends of catenary cable system 16. Extension member guide 400 guides catenary cable system 16 into catenary cable system clamp 370 to reduce the wear on catenary cable system 16 due to combined tension and bending of catenary cable system 16 at the point of entry into catenary cable system clamp 370.

In a preferred embodiment, extension member guide 400 is formed by an upper guide 402 and a lower guide 404, the combined profile of the guides fitting around catenary cable system 16. Upper guide 402 and lower guide 404 are formed with complementary holes so that they may be clamped together by a plurality of bolts.

The holes formed for catenary cable system 16 through extension member guide 400 are slightly larger than the cables of catenary cable system 16. The purpose of the enlarged holes is to provide for limited clamping of catenary cable system 16 without generating the unwanted stress at the outer ends of the clamp. Extension member guide 400 essentially guides catenary cable system 16 more squarely into catenary cable assembly clamp 370. Thereby, the more extreme stresses developed by combined tension and bending of the cable are not experienced. In a preferred embodiment of extension member guide 400, linings 406 are fitted between guide 400 and cable system 16 to provide limited clamping friction therebetween without inducing wear therebetween.

It is therefore evident that the invention claimed herein includes many alternative and equally satisfactory embodiments without departing from the spirit or essential characteristics thereof. Those of ordinary skill in the art having the benefits of the teachings herein will quickly realize beneficial variations and modifications on the preferred embodiments disclosed herein such as that discussed in the above paragraph, all of which are intended to be within the scope of the invention. For instance, all cables in the preferred embodiment are locked-coil steel cables because of their high corrosion resistance, density, and moduli of elasticity as well as their lower sensitivity to bearing pressure. However, other types of cables may also be suitable in some embodiments. The preferred embodiments disclosed above must consequently be considered illustrative and not limiting of the scope of the invention.

What is claimed is:

1. An upper saddle supported by a base pylon for supporting a catenary cable system in an elevated cableway system and providing for deflection of the catenary cable system in response to forces applied by a vehicle traversing a pair of track cable systems supported from the catenary cable system, comprising:

a bearing assembly affixed to the base pylon; and a cable attachment assembly affixed to said bearing assembly to pivot about a point fixed relative to the base pylon, said cable attachment assembly joins a cable of the catenary cable system thereto for supporting the catenary cable system yieldably in relation to said bearing assembly, said bearing assembly being located above said pair of track cable systems.

2. The upper saddle of claim 1 wherein said bearing assembly comprises an assembly for pivotably attaching an upright to the base pylon.

3. The upper saddle of claim 2 wherein said cable attachment assembly comprises:

an upright pivotably mounted to said bearing assembly; and a coupling mounted to and capping the upright for supporting the catenary cable system.

4. The upper saddle of claim 3, further comprising means for bearing the dynamic loads developed in the upright as it deflects in response to forces applied by a vehicle traversing the track cable systems.

5. The upper saddle of claim 3, wherein said assembly for pivotably mounting the upright includes means for bearing the dynamic loads developed in the upright as it deflects in response to forces applied by a vehicle traversing the track cable systems.

6. The upper saddle of claim 3, wherein the upper saddle is supported by a tubular base pylon having an opening in an upper end through which a lower end of the upright extends, and the bearing assembly permits rotation of the upright about the point within the base pylon in response to forces applied by a vehicle traversing the track cable systems.

7. An upper saddle supported by a base pylon for supporting a catenary cable system in an elevated cableway system and providing for deflection of the catenary cable system in response to forces applied by a vehicle traversing a pair of track cable systems supported from the catenary cable system, comprising:

a bearing assembly affixed to the base pylon; and a cable attachment assembly affixed to said bearing assembly to pivot about the base pylon, said cable attachment assembly joins a cable of the catenary cable system thereto for supporting the catenary cable system yieldably in relation to said bearing assembly;

wherein said bearing assembly comprises an assembly for pivotably attaching an upright to the base pylon; wherein said cable attachment assembly comprises: an upright pivotably mounted to said bearing assembly; and a coupling mounted to and capping the upright for supporting the catenary cable system; wherein said coupling comprises: a coupling base; at least two support members affixed to the coupling base and extending substantially perpendicular from the coupling base, the members being spaced apart; a cable connector socketed on one end to engage the support members and on a second end to receive the cable; and means for joining the cable connector to the support members such that the cable connector can pivot relative to said coupling.

* * * * *